United States Patent [19]

Sanford

[11] Patent Number: 4,566,535

[45] Date of Patent: Jan. 28, 1986

[54] DUAL PACKER APPARATUS AND METHOD

[76] Inventor: Lawrence Sanford, 4047 Hollister, Houston, Tex. 77080

[21] Appl. No.: 420,324

[22] Filed: Sep. 20, 1982

[51] Int. Cl.[4] ..... E21B 23/06; E21B 33/124; E21B 43/00

[52] U.S. Cl. ..... 166/113; 166/143; 166/152; 166/191; 166/250

[58] Field of Search ..... 166/191, 143, 152, 149, 166/145, 250, 113, 264

[56] References Cited

U.S. PATENT DOCUMENTS

| | | | |
|---|---|---|---|
| 2,280,785 | 4/1942 | Boynton | 166/113 |
| 2,618,340 | 11/1952 | Lynd | 166/113 |
| 2,831,541 | 4/1958 | Conover | 166/191 X |
| 2,978,046 | 4/1961 | True | 166/264 |
| 3,111,169 | 11/1963 | Hyde | 166/145 |
| 3,182,726 | 5/1965 | Store, Jr. | 166/145 |
| 3,327,781 | 6/1967 | Nutter | 166/145 |
| 4,230,180 | 10/1980 | Patton | 166/264 |

*Primary Examiner*—James A. Leppink
*Assistant Examiner*—Bruce M. Kisliuk
*Attorney, Agent, or Firm*—Browning, Bushman, Zamecki & Anderson

[57] ABSTRACT

A dual packer apparatus comprises a tubular outer assembly including upper and lower packers interconnected and spaced apart by tubular spacers. Ports in the outer assembly provide for communication with a well zone between the two packers and a well zone below the lower packer. A tubular inner assembly may be separately assembled and inserted into the outer assembly as assembled. The apparatus may be alternately placed in a number of different operating positions downhole by manipulation of an operating string attached to the inner assembly. Various design features provide special protection for annular seals between the two assemblies. An improved sensor and method of installing the sensor in the inner assembly are also provided.

36 Claims, 36 Drawing Figures

FIG.5E
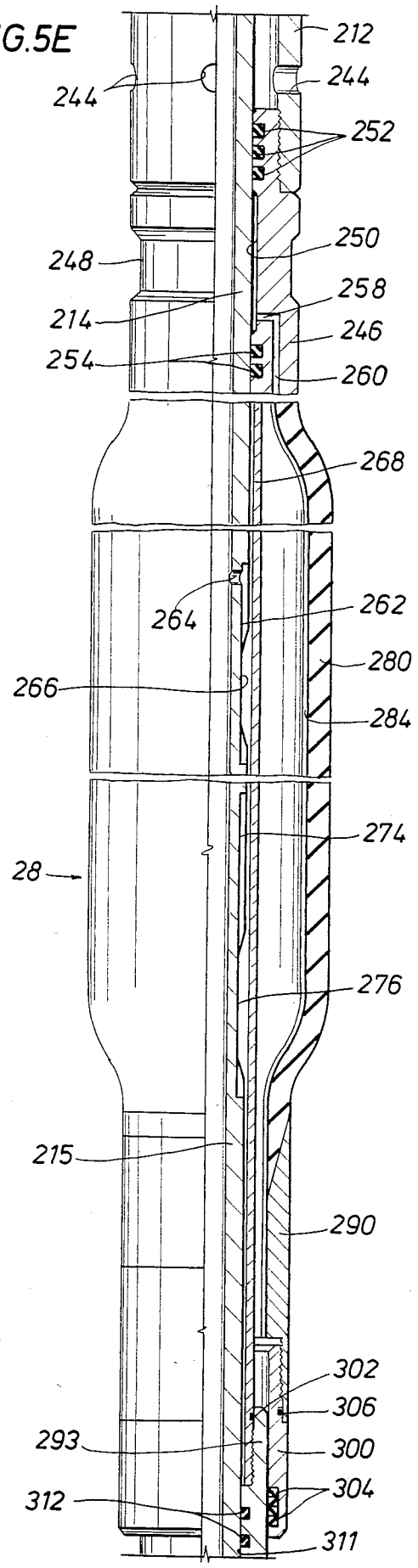
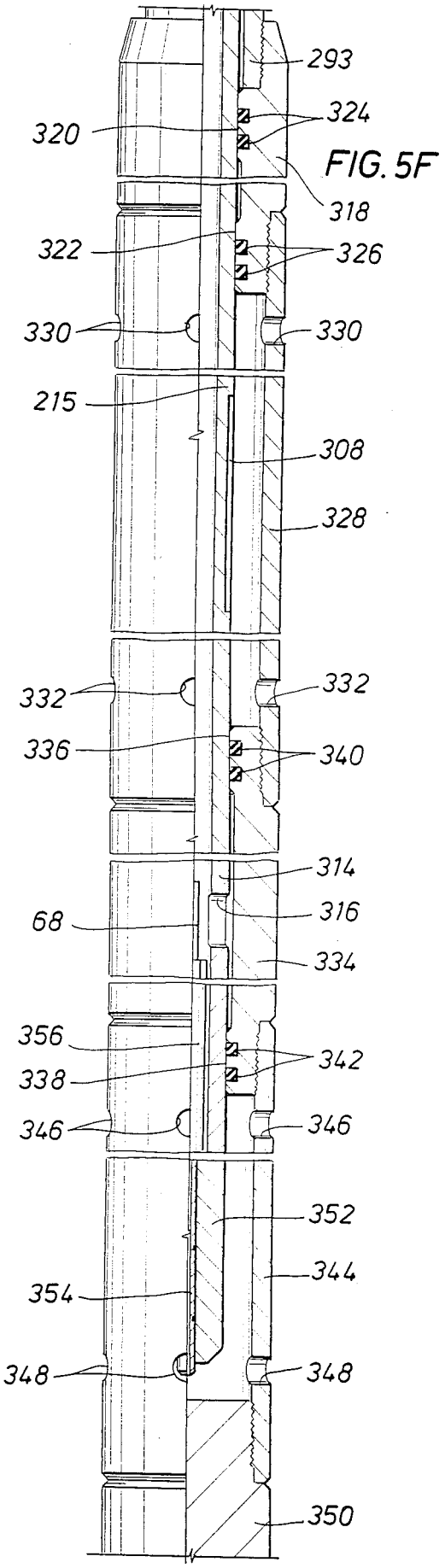
FIG. 5F

DUAL PACKER APPARATUS AND METHOD

BACKGROUND OF THE INVENTION

The present invention pertains to a type of tool which will be referred to herein as "dual packer apparatus," and is more commonly referred to as a "straddle packer." This type of apparatus generally includes two packers run in longitudinally spaced positions on a common operating string. After the apparatus has been run into a well bore, the packers may be set to separate three consecutive zones of the well from one another. Such isolation may be required to permit the performance of testing and other operations on various of these zones individually. It is generally desirable that the apparatus permit successive operations of this sort upon different zones without removal and re-running of the operating string and with a minimum of manipulation of the tool.

At least one other straddle packer type apparatus is known to be currently available. One major problem with this existing apparatus is difficulty of assembly. Because of the size of the apparatus, it is impractical, if not impossible, to deliver it to the well site in assembled condition. The tool includes both inner and outer parts. Each inner part is pre-positioned in its respective outer part so that as the tool is assembled at the well site, the inner and outer parts must be separately supported during the assembly process. This in turn requires the use of special, complicated elevators, and is generally a time-consuming, tedious and troublesome process.

Further complicating the procedure is the fact that a sensor line, e.g. for sensing temperature and/or pressure, is usually installed within the straddle packer apparatus, and extending along its length. Such a sensor line typically represents still a third set of parts which must be assembled and installed in the context of the already complicated assembly procedure described above.

SUMMARY OF THE INVENTION

The present invention contemplates a dual packer apparatus and assembly method wherein a tubular outer assembly, comprising upper and lower packers interconnected and longitudinally spaced by tubular spacer means, is assembled and supported on first support means, such as a simple clamp located at the rotary table of a drilling rig. A tubular inner assembly is separately assembled, supported on second support means, and lowered into the outer assembly. The entire inner assembly may theoretically be lowered, in fully assembled condition, generally coaxially into the outer assembly. More typically, the inner assembly is gradually or incrementally lowered into the outer assembly as the inner assembly is made up. In any event, the need to simultaneously assembly pairs of inner and outer members is eliminated. The two assemblies are then interconnected, whereafter the first support means may be released and the entire apparatus supported on the second support means. To permit the insertion of the inner assembly, as assembled, into the outer assembly, the outer assembly, at each point along its length, has an inner diameter greater than the outer diameter of the inner assembly at an adjacent point along its length and all points therebelow.

Where a sensor line is employed, it preferably comprises a dart or probe, a weight secured to the upper portion of the probe, and a monolithic tubular body such as a length of coiled tubing, extending from the weight. Thus, the probe, weight, and tubing may be suitably connected at closely adjacent points, and the dart or probe lowered into the inner assembly and carried downwardly by the weight. The coiled tubing is unwound to permit such lowering of the probe, which is adapted to stab into a seat in the lower end of the inner assembly and is thereby properly positioned for communication with the exterior of the apparatus. This simple and fast method of installing the sensor line is highly compatible with the general assembly method of the invention.

As mentioned, the outer assembly includes a pair of spaced apart packers. The outer assembly further defines a pair of packer set chambers each associated with a respective one of the packers for receipt of fluid whereby the packer may be set. The outer assembly also has mid port means communicating the interior with the exterior of the outer assembly between the packers, as well as lower port means communicating the interior with the exterior of the outer assembly below the lower packer. The inner assembly has fluid passage means, such as a series of lateral ports, communicating the interior with the exterior of the inner assembly. The apparatus further includes a plurality of longitudinally spaced annular seal means each carried by one or the other of the assemblies for sealing between those assemblies.

The means interconnecting the inner and outer assemblies permits relative telescopic movement of the assemblies between a plurality of positions. As the inner and outer assemblies are telescopically moved relative to one another, the interrelation of the assemblies, the fluid passage means of the inner assembly, the port means of the outer assembly, and the seal means are varied. Among the various operating positions which may be thus established are the following: an inflation position, wherein the fluid passage means of the inner assembly communicates with the packer set chambers; a lower flow position, wherein the fluid passage means communicates with the lower port means of the outer assembly, and the packer set chambers are sealed with respect to the inner assembly and blocked from the fluid passage means; and a mid flow position, wherein the fluid passage means communicate with the mid port means, and the packer set chambers are sealed with respect to the inner assembly and blocked from the fluid passage means.

In preferred embodiments, the seal means and assemblies are arranged to maintain the packer set chambers sealed with respect to the inner assembly and blocked from the fluid passage means, i.e. to keep the packers set, as the assemblies are moved between the lower flow and mid flow positions. This permits alternate testing or other operations on two adjacent zones of the well without deflation and resetting of the packers which isolate those zones.

In preferred embodiments, the outer assembly also includes upper port means communicating the interior with the exterior of the outer assembly above the upper packer. In the inflation position, the inner and outer assemblies define an annular pressure relief bypass therebetween communicating the mid port means with the upper port means. This prevents excess pressure from being trapped between the packers as they are inflated. A similar bypass communicates the lower port means with the mid port means to prevent pressurized fluid from being trapped below the lower packer. In the flow positions, one or more of the seal means seal between the assemblies to close the bypasses. Such preferred embodiments further include an equalizing position, wherein each of the upper, lower and mid port means of the outer assembly communicates with the fluid passage means of the inner assembly, and said packer set chambers are sealed with respect to the inner assembly and blocked from the fluid passage means, as well as a pull out position, wherein each of the packer set chambers communicates with at least one of the port means of the outer assembly.

The equalizing position is normally assumed after inflation of the packers but prior to assumption of either of the two flow positions. The equalizing position further ensures against the trapping of excess pressure between the two packers or below the lower packer and permits the pressures in the three zones of the well to equalize prior to testing or other operations. Conveniently, the equalizing position is automatically assumed as the apparatus is moved from the inflation position to either of the two flow positions.

The apparatus permits the packers to be deflated, moved, and reset downhole any number of times without pulling and rerunning of the operating string. However, when it is desired to pull the operating string, the apparatus is preferably placed in the aforementioned pull out position, which allows the packer set chambers to empty into the well annulus, as opposed to the interior of the inner assembly of the dual packer apparatus. This positively prevents re-inflation of the packers and thereby eliminates any tendency of the apparatus to swab the hole as it is being pulled.

Preferred embodiments of the invention also include features which minimize wear and damage to various of the seal rings which are carried by the assemblies for sealing therebetween. For example, the apparatus has a plurality of lengthwise zones, and the sealing diameters of the seal rings decrease between successively lower zones. This minimizes rubbing contact with the sealing surfaces as the inner assembly is lowered into the outer assembly.

Also, the two assemblies are interconnected for their telescopic movements by means such as lugs and slots. By various longitudinal and rotative movements of the lugs relative to the slots, the various tool positions are determined. The inner or operating assembly incorporates a swivel between its upper portion (adjacent the lugs and slots) and its lower portion. Thus, only the upper portion of the inner assesmbly is rotated when changing tool positions. This not only eliminates seal wear, but also facilitates accurate determination of the various tool positions.

Accordingly, it is a principal object of the present invention to provide an improved dual packer apparatus.

A further object of the present invention is to provide a dual packer apparatus and method of assembling same wherein an inner tubular assembly may be assembled independently of a tubular outer assembly and inserted into the outer assembly as assembled.

Still another object of the present invention is to provide an improved method and apparatus for installing a sensor in the lower end of such a packer apparatus.

Still another object of the present invention is to provide a dual packer apparatus having a plurality of advantageous relative positions which may be assumed by its inner and outer assemblies and improved means for determining those positions.

Yet another object of the present invention is to provide means for protecting the seals of a dual packer apparatus.

Still another object of the present invention is to provide such an apparatus with bypasses permitting well pressure relief during inflation.

Still other objects, features, and advantages of the present invention will be made apparent by the following detailed description, the drawings and the claims.

BRIEF DESCRIPTION OF THE DRAWINGS

FIGS. 5A–5F are quarter-sectional views of selected, progressively lower portions of the apparatus in the mid flow position.

DETAILED DESCRIPTION

Figure 1A:
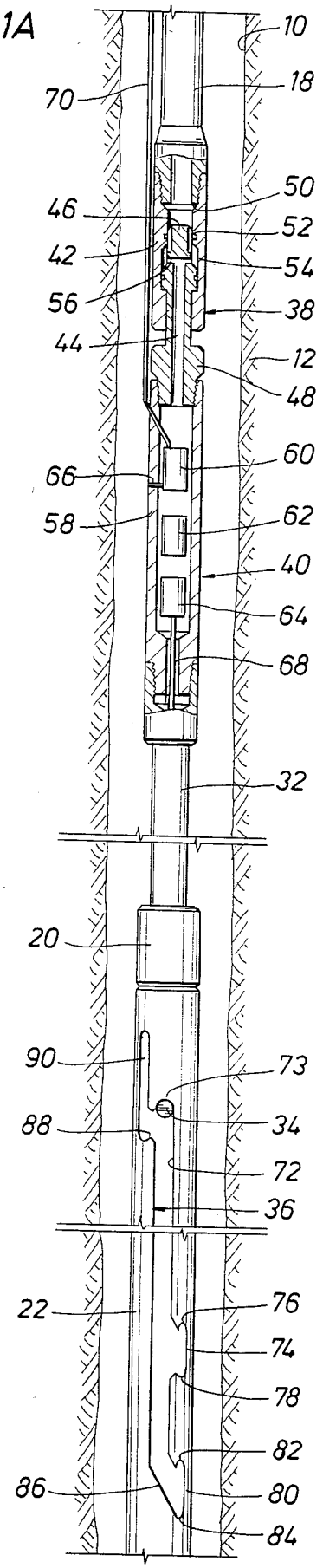
FIGS. 1A and 1B represent a longitudinal elevational view, with some parts shown in cross section, of a dual packer apparatus according to the present invention, emplaced in a well bore, and with the packers inflated, the two figures representing upper and lower portions of the tool respectively.
Figure 1B:
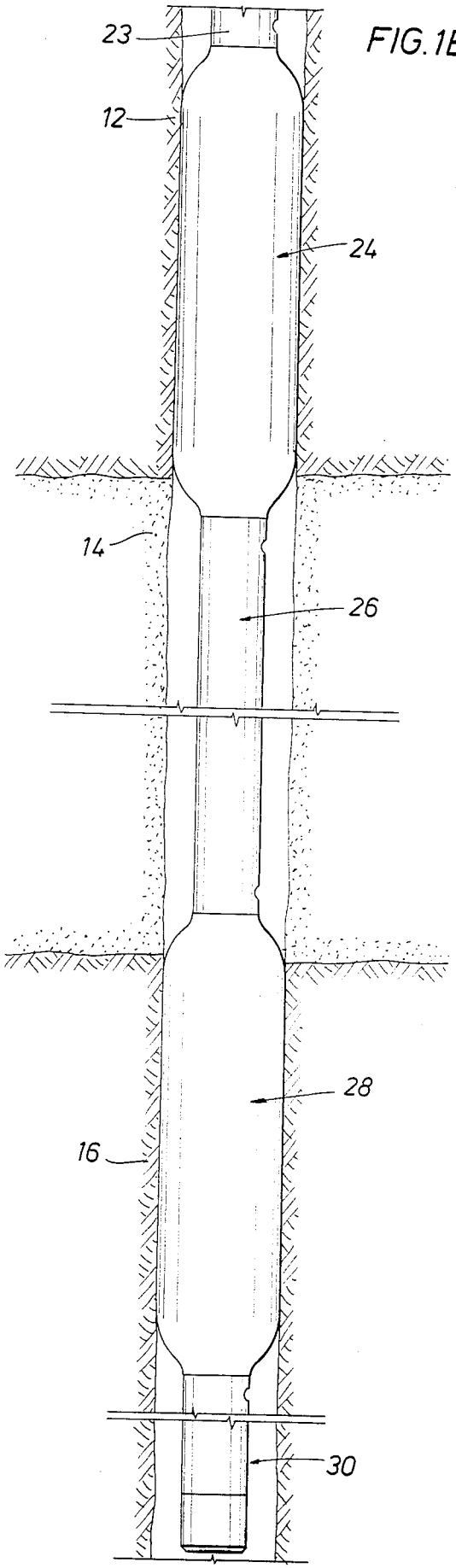

Referring first to FIGS. 1A and 1B, there is shown a well bore 10 which extends downwardly through a plurality of different strata or types of earth formations, three of which are indicated at 12, 14 and 16. Areas 12, 14 and 16 could also represent three zones within a single stratum. Extending into well 10 is an operating string 18 which carries a dual packer apparatus according to the present invention. The dual packer apparatus includes a tubular outer assembly comprising a series of threadedly connected upper subs 20, 22 and 23, an upper packer 24 carried on the lower end of sub 23, a series 26 of threadedly connected spacer subs extending downwardly from the lower end of packer 24, a lower packer 28 connected to the lower end of spacer subs 26, and a series 30 of lower subs extending downwardly from packer 28 and threadedly connected to one another.

The dual packer apparatus further includes a tubular inner assembly, an upper section of which is shown at 32 in FIG. 1A, disposed coaxially within the outer assembly. Both the inner and outer assemblies will be described more fully hereinafter. Briefly, the inner assembly forms an extension of the lower end of operating string 18. The upper portion of the inner assembly carries a pair of diametrically opposed lugs, one of which is shown at 34. Each lugs 34 extends radially outwardly into a slot 36 formed in sub 22 of the outer assembly. Thus, the outer assembly is suspended on the inner assembly and carried by the operating string 18.

Mounted above section 32 of the inner assembly within the operating string, and thus associated with the inner assembly, are a valve assembly 38 and a recorder carrier tool 40. Valve assembly 38 may be of any suitable type, as well known in the art, which may serve to open and close the interior of the operating string 18, and thus the inner assembly of the packer apparatus, preferably by virtue of longitudinal reciprocating movements of the operating string. As diagrammatically illustrated in FIG. 1A, valve assembly 38 includes a tubular housing 42. Telescopically mounted in housing 42 is a plunger member 48. The lower portion of plunger 48 has a central tubular passageway 44, which forms a continuation of the central interior flowway of the operating string and the tools carried thereby. At the upper end of plunger 48, the bore 44 is blocked by a solid formation 46. The upper end of housing 42 forms a threaded box which receives a pin formed on the lower end of the operating string 18 thereabove. This pin forms a downwardly facing annular shoulder 50 within housing 42. The lower end of plunger 48 likewise forms a threaded pin which is connected to the housing of recorder carrier 40 as shown.

It can be seen that, if the lower portions of the operating string connected to plunger 48, including recorder carrier 40 and the inner assembly of the dual packer apparatus, are held stationery, housing 42 can be lowered and raised by the upper portion of the operating string, moving shoulder 50 toward and away from solid formation 46 on plunger 48. When shoulder 50 and formation 46 are spaced apart, as shown in FIG. 1A, fluid from the interior of the operating string 18 can bypass formation 46 through grooves 52 formed in the exterior thereof, an enlarged diameter clearance area 54 in housing 42, and a cross bore 56 intersecting central bore 44. Thus, fluid may pass through operating string 18 and into the inner assembly of the dual packer apparatus. However, the diameters of shoulder 50 and formation 46 are such that, when brought into engagement, they will block grooves 52 and thereby close the interior of the inner assembly of the packer apparatus from communication with the operating string 18 thereabove.

Recorder carrier 40 may likewise be of a type well known in the art. Thus, recorder carrier 40 is only diagrammatically illustrated and briefly described. Recorder carrier 40 includes a generally tubular housing 58 within which are disposed three units 60, 62 and 64 for receiving and processing data, typically temperature and pressure data, from various zones of well 10 separated by packers 24 and 28. Specifically, unit 60 is communicated with zone 12 through a radial line 66 extending outwardly through housing 58. Unit 62 communicates directly with the interior of housing 58 and, thus, with the interior of the inner assembly of the packer apparatus. This space in turn communicates with zone 14 located between the two packers when the apparatus is in the mid flow position described below. Finally, unit 64 communicates with lower zone 16 through a sensor line 68, to be described more fully below. Information processed by units 60, 62 and 64 is transmitted uphole through line 70 running parallel to and carried by operating string 18.

The structure and function of the dual packer apparatus will be more fully describd hereafter. Briefly, the apparatus is run into the well to the desired depth. The number and size of subs in the spacer section 26, and a corresponding section in the inner assembly of the apparatus, will have been chosen so that, when the tool reaches the desired depth, packers 24 and 28 will be located near the boundaries of the well zones to be separated from one another. As shown in FIG. 1A, slot 36 is of substantially greater longitudinal and circumferential extent than lug 34. Thus, the inner and outer assemblies may be telescopically moved relative to each other to a plurality of positions. Various positions of lugs 34 in slots 36 determine these operating positions of the apparatus.

More specifically, each slot 36 includes a first or primary longitudinal run 72. At the upper end of run 72, there is a downwardly facing shoulder 73 which, when engaged by the respective lug 34, supports the outer assembly on the inner assembly and determines the inflation position of the apparatus. The tool is run into the well in the inflation position. When the tool reaches the desired depth, fluid pressure is applied through operating string 18 and the inner assembly of the packer apparatus to inflate packers 24 and 28 as shown. Packers 24 and 28 may be maintained temporarily in this inflated condition by holding the pressure within operating string 18. With the packers inflated, the outer assembly of the packer apparatus will be held stationery, and the inner assembly may be telescopically moved with respect thereto by manipulation of the operating string.

Typically, from the position of FIGS. 1A and 1B, the operating string is lowered to begin moving lug 34 downwardly in run 72 of slot 36. When lug 34 reaches a predetermined distance below shoulder 73, the inner and outer assemblies will have assumed an equalizing position or series of positions wherein the three zones 12, 14 and 16 of the well will be communicated with one another so as to equalize the pressures therein. Also, as lug 34 moves downwardly in run 72, and before it reaches lateral pocket 74, the assemblies will have assumed positions (at least some of which are coincident with the equalizing position(s)) so as to seal packers 24 and 28 in their inflated condition whereby it is no longer necessary to maintain pressure in operating string 18. This condition prevails throughout the various other positions assumed by the tool as lug 34 continues to move downwardly.

When lug 34 reaches a position aligned with pocket 74, the operating string 18 may be rotated in a counterclockwise direction to move lug 34 into pocket 74. Positioning of lug 34 in pocket 74 determines a lower flow position of the tool wherein the interior of the inner assembly is communicated with zone 16 of the well below lower packer 28. Pocket 74 defines downwardly and upwardly facing shoulders 76 and 78 respectively. By engaging lug 34 with shoulder 76, an open condition of valve assembly 38 may be insured. If it is desired to close the valve assembly 38, such action is permitted by engagement of lug 34 with upwardly facing shoulder 78 followed by continued lowering of the operating string to bring formation 46 into engagement with shoulder 50 of valve assembly 38.

To move the assemblies to a different relative position, operating string 18 is rotated clockwise to remove lug 34 from pocket 74. Then, for example, the operating string can be further lowered to move lug 34 downwardly in run 72, and eventually into a pocket 80 formed at the lower end of run 72. It should be noted that pocket 80 is spaced from shoulder 73 in the same longitudinal and circumferential directions as is pocket 74. An inclined surface 82 formed at the lower end of run 72 opposite pocket 80 helps to guide lug 34 into pocket 80. Engagement of lug 34 in pocket 80 determines a mid flow position of the packer apparatus in which the interior of the inner assembly is communicated with zone 14 between packers 24 and 28. Like pocket 74, pocket 80 includes downwardly and upwardly facing stop shoulders 82 and 84 respectively, which may be engaged by lug 34 to select, respectively, either an open condition or a closed condition of valve assembly 38 for the mid flow position of the packer apparatus.

The apparatus may be moved between the lower flow, mid flow, and inflation positions by suitable manipulations of the operating string as many times as desired. All of this may be accomplished without removing the string from the well bore 10. As the apparatus is moved between the lower flow and mid flow positions, the packers are maintained in their inflated conditions. If it is desired to move the apparatus to a different position in the well, or for any other reason, to deflate packers 24 and 28, the apparatus is simply returned to the inflation position determined by abutment of lug 34 with shoulder 73. Thus, the packer may be inflated and deflated as many times as desired downhole.

If it is determined that the operating string should be removed from the borehole, and that there will be no further need to inflate the packers, lug 34 is moved to the upper end of run 72, and the operating string is rotated clockwise to move lug 34 through a circumferential run 88 of slot 36 and into a second longitudinal run 90. It should be noted that run 90 is spaced from shoulder 73 in the opposite circumferential direction from pockets 74 and 80, and also, that run 90 extends generally upwardly with respect to shoulder 73, whereas pockets 74 and 80 are spaced downwardly therefrom. As lug 34 moves upwardly in run 90, the inner and outer assemblies of the dual packer apparatus will assume a pull out position in which the fluid-receiving or packer set chambers of packers 24 and 28 will be directly communicated with the exterior of the tool, i.e. with the well bore, as opposed to the interior of the inner assembly. This positively prevents reinflation of the packers, and thus, swabbing of the well or damage to the packers as the string is pulled.

Figure 2A:
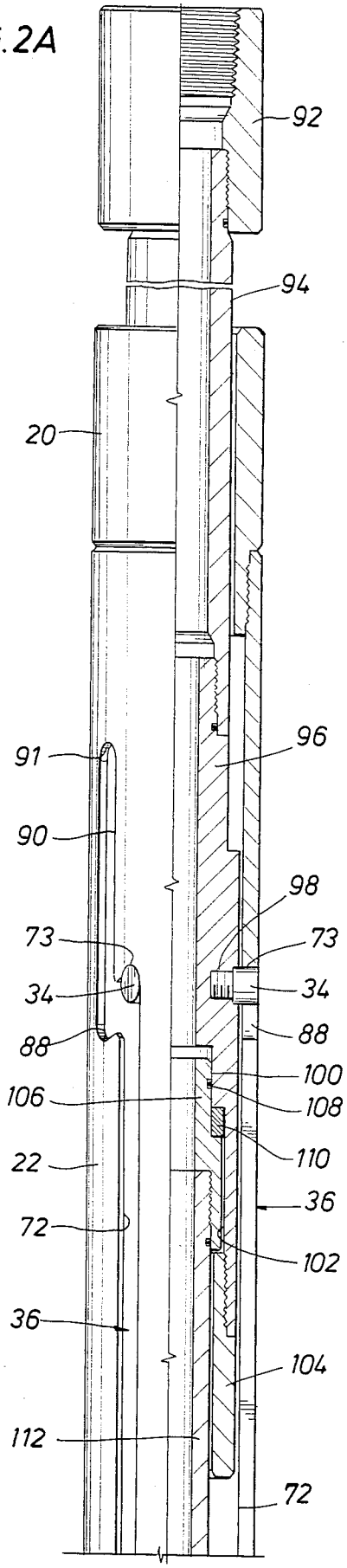
FIGS. 2A–2J are quarter-sectional views, on an enlarged scale, of successive lengthwise portions of the apparatus in the inflation position.
Figure 2B:
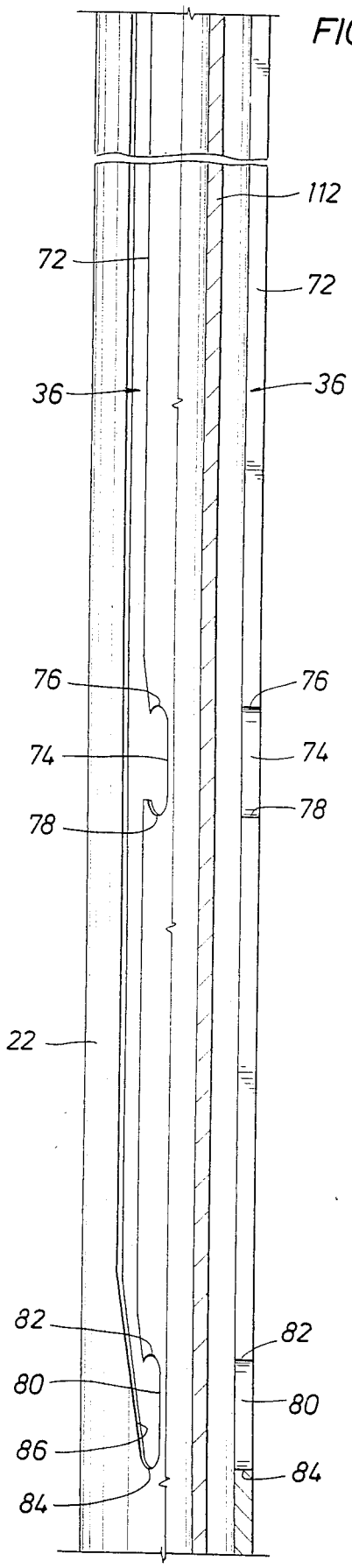

Referring now to FIGS. 2A–2J, the dual packer apparatus will be described in greater detail. FIGS. 2A and 2B show section 22 of the outer assembly, in which diametrically opposed slots 36, described hereinabove, are formed. The inner assembly is comprised of a number of tubular sections, threadedly and sealingly connected to one another. These sections will be described in greater detail to the extent that they differ from one another. In general, some of the sections, such as that shown at 92, are in the form of short subs, collars, or nipples, while others, such as that shown at 94, are in the form of elongate tubes. Threadedly and sealingly connected to tube 94 is a section 96, the lower portion of which has an enlarged outer diameter. The enlarged diameter portion provides a thickened section having a pair of diametrically opposed tapped bores, one of which is shown at 98, the bores receiving respective lugs 34 which, as described hereinabove, ride in respective slots 36.

Below the thickened section which receives lugs 34, member 96 has its inner diameter counterbored at 100, and further counterbored at 102. The lowermost portion of counterbore 102 is internally threaded to receive a retaining member in the form of a brass bearing 104. The upper end of member 104 and the shoulder formed between counterbores 100 and 102 form opposed, longitudinally facing retaining shoulders. A swivel member 106 has an upper portion sized for sliding receipt in counterbore 100, and sealed with respect thereto by an O-ring 108, and an enlarged diameter lower portion sized for receipt in counterbore 102. The lower end of swivel member 106 opposes the upper end of retainer member 104, and the shoulder between the large and small diameter outer portions of member 106 opposes the shoulder formed between counterbores 100 and 102, whereby relative longitudinal movement between swivel member 106 and section 96 of the inner assembly of the packer apparatus is limited. Preferably, a bearing ring 110 is positioned between the last two mentioned retaining shoulders, and in radial contact with both members 106 and 104. The next adjacent tubular section 112 of the inner assembly of the packer apparatus is threaded into the lower end of swivel member 106.

Swivel member 106 permits the upper portion of the inner assembly, carrying lugs 34, to be rotated relative to the outer assembly, for manipulation of lugs 34 in slots 36 as described hereinabove, without corresponding rotation of the portions of the inner assembly therebelow. This in turn prevents unnecessary rubbing contact of various seals in the apparatus to prevent wear and damage. It can also be appreciated that, due to the length of the tool, if it were necessary to rotate the entire inner assembly when moving lugs 34 in slots 36, a high torque would prevail, and the inner assembly might twist. Thus, the swivel makes determination of the various tool positions by use of lugs 34 and slots 36 easier and more reliable.

The outer assembly has a number of ports spaced along its length and communicating its interior with its exterior. Those ports located above the inflatable body 168 (FIGS. 2D and 2E) of upper packer 24 will be referred to herein as "upper ports" of the outer assembly. These upper ports include slots 36. The ports located between the bodies 168 and 280 (FIG. 2H) of upper and lower packers 24 and 28 respectively will be referred to as "mid ports," and the ports located below body 280 will be referred to as "lower ports."

Figure 2C:
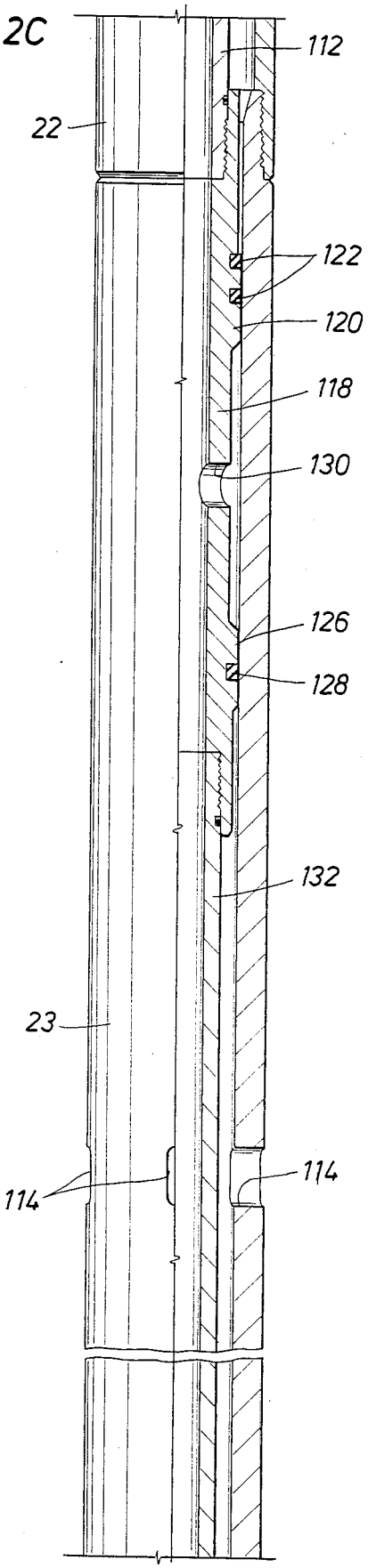
Figure 2D:
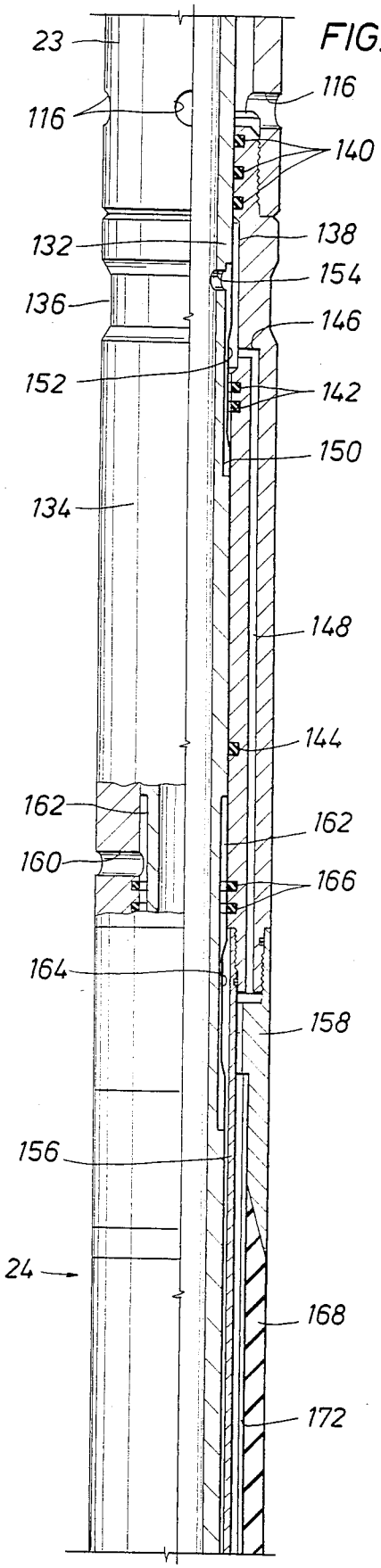

Referring next to FIG. 2C, it may be seen that section 22 of the outer assembly is threadedly connected to section 23 which has a smaller inner diamter than section 22 thereabove. Section 23 has a set of slot-like upper ports 114 extending radially therethrough to communicate the interior with the exterior of the outer assembly. Slot-like ports 114 are spaced a substantial distance below the upper end of section 23. As shown in FIG. 2D, another set of upper ports 116 is formed just above the lower end of section 23.

Still referring to FIG. 2C, the lower end of section 112 of the inner assembly is threadedly connected to a relatively thick walled tubular section 118. Section 118 has a first exterior upset 120 near its upper end sized so that annular seals 122 carried thereby may sealingly engage the inner diameter of section 23 of the outer assembly when disposed therein. A second exterior upset 126 is spaced below upset 120, and carries seal ring 128, likewise sealingly engaging the inner diameter of section 23 of the outer assembly.

The inner assembly of the apparatus includes a system of fluid passage means communicating the interior with the exterior of the inner assembly. This fluid passage means comprises a series of radial bores spaced longitudinally along the inner assembly. The first such set of bores is formed in section 118 between upsets 120 and 126, one of the ports of this first set being shown at 130. Below upset 126, section 118 is threadedly connected to the next, relatively thin-walled, section 132 of the inner assembly of the apparatus.

Figure 2E:
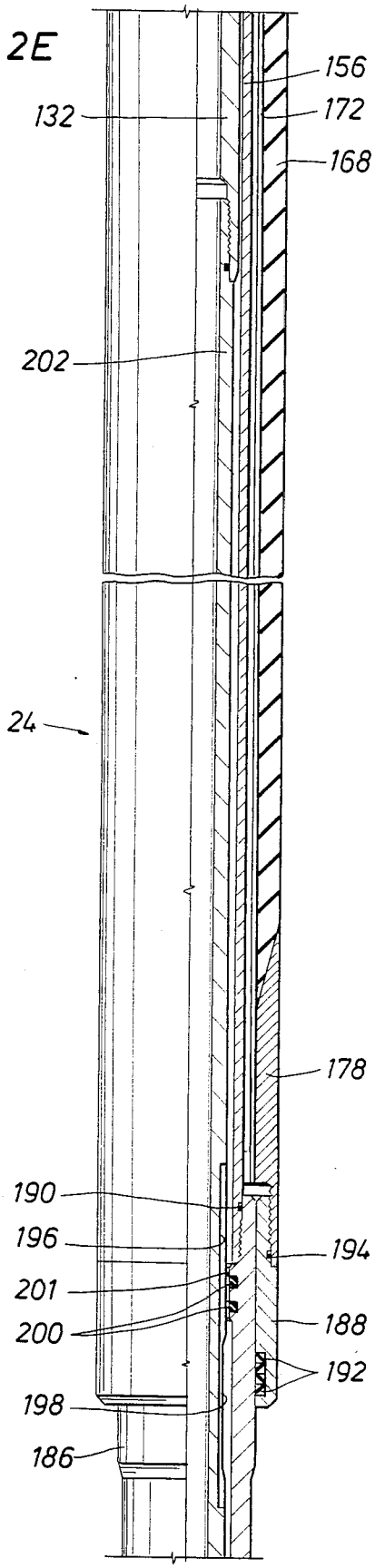

Referring next to FIGS. 2D and 2E, section 23 of the outer assembly of the dual packer apparatus is threadedly connected to the upper end of section 134, which forms an extension of the upper end of packer 24. Near its upper end, section 134 has a necked-down area 136, which may be engaged for handling of the attached packer in a manner well known in the art. On the interior of its upper end, generally aligned with necked-down area 136, section 134 has a shallow annular recess 138, i.e. an area of enlarged inner diameter. Above recess 138, section 134 carries a set of seal rings 140 sized to sealingly engage the major diameter of section 132 of the inner assembly. One of seals 140 may be a wiper, and the other two packing type seals. Below recess 138, section 134 carries a set of two seal rings 142, likewise sized to seal against the major diameter of section 132 of the inner assembly. Spaced below seals 142, is still another seal ring 144, also sized to seal against the major diameter portion of section 132 of the inner assembly.

Intermediate seals 140 and seals 142, and communicating with recess 138, is a bore 146 extending radially outwardly from the interior of section 134 to intersect a longitudinal bore 148 extending downwardly from bore 146. Bore 146 defines the inlet of the packer set chamber of upper packer 24, and bore 148 defines an upper portion of that chamber. Seals 140, located longitudinally on one side of inlet 146 serve as the first packer seals; seals 142, located longitudinally on the opposite side of inlet 146 from seals 140, serve as the second packer seals; and seal 144, located across seals 142 from inlet 146, serves as the auxiliary packer seal.

The portion of section 132 of the inner assembly which lies generally adjacent the upper end of section 134 of the outer assembly in the inflation position (as shown in FIG. 2D) has a series of external longitudinal slots, one of which is shown at 150, cut into its outer surface and circumferentially spaced from one another. Near its upper end, one of the slots 150 is intersected by a bore 154, which is a part of the aforementioned fluid passage means of the inner assembly and, more specifically, serves as the packer set port for upper packer 24. Below bore 154, but in communication with slots 150, section 132 of the inner assembly has a reduced outer diameter area or undercut 152.

With the apparatus in its inflation position, as shown, packer set port 154 communicates via slot 150, undercut 152 and recess 138 with inlet 146 of the packer set chamber. Second packer seals 142, like inlet 146, are in register with undercut 152 in the inflation position, and thus do not sealingly engage section 132 of the inner assembly. However, first packer seals 140 and auxiliary packer seal 144 sealingly engage between section 134 of the outer assembly and section 132 of the inner assembly on opposite sides of the generally open area defined by port 154, slot 150, recess 138, undercut 152, and inlet 146. Thus, pressurized fluid from port 154 is prevented by seals 140 and 144 from bypassing section 134 of the outer assembly, and is thus forced into inlet 146 of the packer set chamber. It should be noted, however, that due to the presence of slots 150 and undercut 152, the pressure above and below seals 142 will be equal during inflation.

The lower end of section 134 of the outer assembly has both internal and external threads for connection to the packer proper. The internal thread receives the upper end of the inner mandrel 156 of packer 24, while the outer thread receives the upper end of packer head 158. Above these threaded connections to the packer proper, and specifically between seals 144 and 166, section 134 is provided with at least one radial bore 160, circumferentially offset from bore 148 of the packer set chamber. Bore 160 forms the lowermost one of the upper ports of the outer assembly as a whole. In the inflation position, bore 160 is aligned with and communicates with at least one of a series of longitudinal slots 162 cut into the exterior of section 132 and spaced circumferentially from one another. Intermediate their ends, slots 162 are communicated with one another by a reduced diameter section or undercut 164. It is further noted that, in the inflation position, seal rings 166 carried by section 134 just above its lower threaded connections to the packer proper, and sized to engage the major diameter portion of section 132 of the inner assembly, are in register with slots 162. Slots 162, undercut 164, and bore 160 form a part of a pressure relief bypass system, to be described more fully hereinbelow.

Bore 148 extends through the lower end of section 134 to communicate with the major portion of the packer set chamber of packer 24. Said major portion of the packer set chamber is defined by the annular space between mandrel 156, on the one hand, and head 158 and the attached elastomeric packer body 168, on the other hand. Packer 24, as shown, is an inflatable type packer, although other types of fluid set packers may be employed. The construction of such packers is well known in the art, and will not be described in detail herein. Breifly, the upper end of elastomeric packer body 168 is attached to head 158 in any suitable manner as well known in the art. A layer of reinforcing material 172, such as platted, braided, or otherwise interconnected metal cables, may extend along the inner surface of body 168 as shown, preferably bonded thereto, or may be embedded in body 168.

The lower end of packer body 168 is similarly secured to a lower packer head 178. The lower end of packer 24 is generally a mirror image of the upper end, the primary difference being that the lower packer head 178 is movable with respect to mandrel 156, in order to allow for inflation without undue stretching of body 168. Accordingly, mandrel 156 is threadedly connected to the next adjacent section 186 of the outer assembly of the apparatus, while head 178 is threadedly connected to a guide member 188 slidably surrounding section 186. The lower end of the packer set chamber is closed off by: seal 190, sealing between mandrel 156 and section 186; sliding seals 192, sealing between guide member 188 and member 186; and O-ring 194, sealing between guide member 188 and lower packer head 178.

The lower end of section 132 of the inner assembly, which is disposed generally intermediate the ends of packer 24 in the inflation position, is threadedly and sealingly connected to the upper end of a section 202, of slightly smaller outer diameter, which extends downwardly through the lower end of packer 24. Near the lower end of packer 24, section 202 has a plurality of circumferentially spaced longitudinal slots, one of which is shown at 196, formed in its outer surface. Slightly above their lower ends, slots 196 are interconnected by a reduced diameter or necked-down area 198. In the inflation position, as shown in FIG. 2E, seal rings 200 carried near the upper end of section 186 of the outer assembly are positioned adjacent slots 196. In addition, because seal rings 200 are sized to sealingly engage the larger diameter section 132 above section 202, an additional annular clearance is provided between seals 200 and section 202 in the inflation position.

Figure 2F:
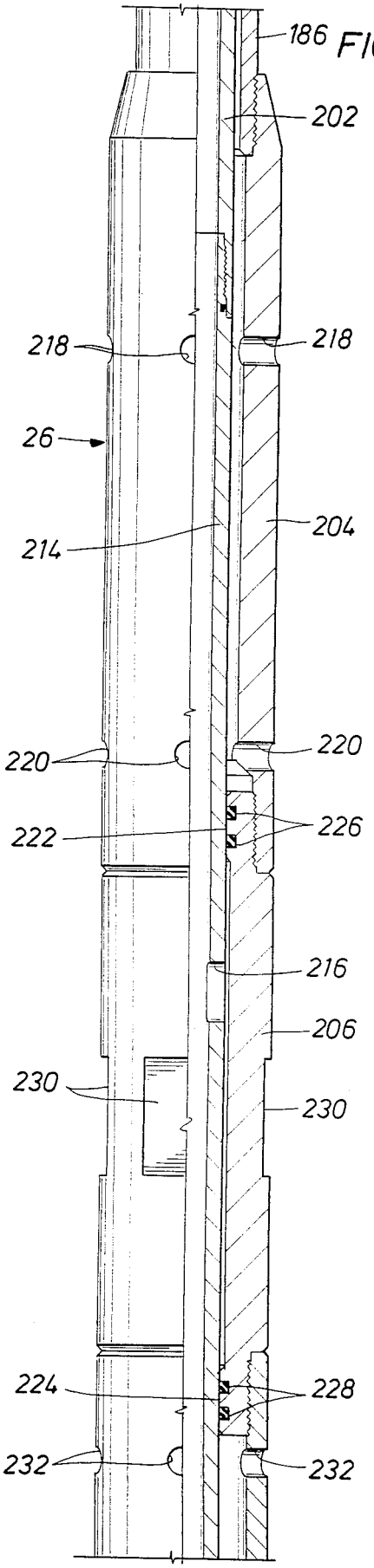
Figure 2G:
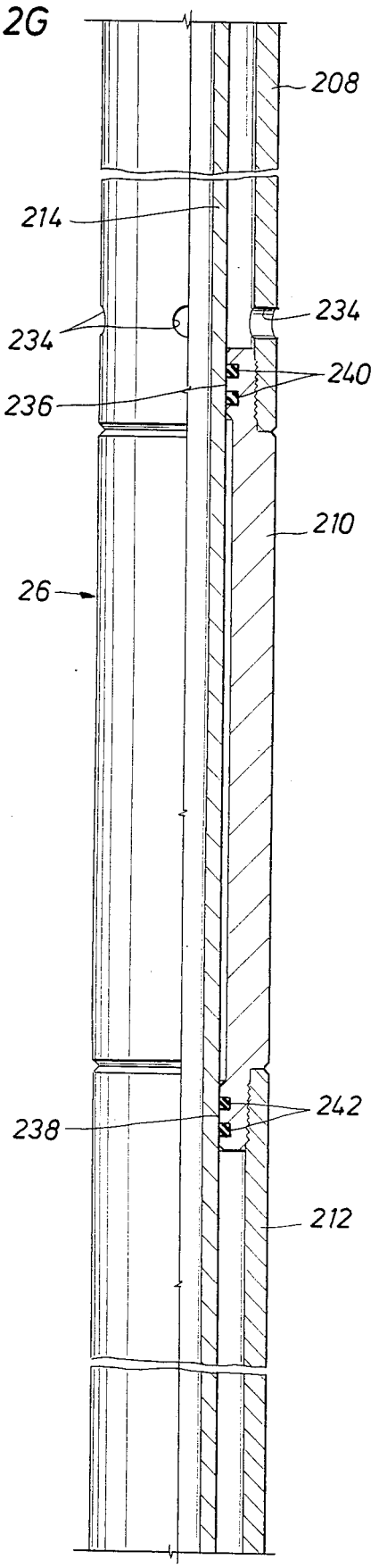

FIGS. 2F and 2G illustrate the spacer portion 26 of the outer assembly and corresponding parts of the inner assembly in the inflation position. The spacer portion 26 of the outer assembly includes consecutive tubular members or sections 204, 206, 208, 210, 212. The corresponding portion of the inner assembly includes a long tubular member 214 threadedly connected to member 202 and extending through the aforementioned spacer sections of the outer assembly and into the vicinity of the lower packer 28 (See FIG. 2H). Section 214 of the inner assembly is a generally straight cylindrical member, of the same thickness as member 202 connected thereabove, its cylindrical inner and outer surfaces being interrupted only by a set of lateral slot-shaped ports 216 forming a part of the fluid passage means of the inner assembly and by additional special formations, to be described hereinbelow, at the lower end of member 214 in the vicinity of lower packer 28. The length of member 214 is precisely regulated, in relation to the lengths of members 204–212 of the outer assembly, so that proper relationships between the various ports, seals, etc. of the inner and outer assemblies will be maintained. It will be understood that, if a different spacing between upper and lower packers 24 and 28 is desired, the numbers and/or sizes of the tubular members in the spacer portion of the tool could be varied.

Upper spacer member 204 of the outer assembly is a relatively thick-walled member threadedly connected to member 186 thereabove, and having a slightly greater inner diameter. Member 204 has a first set of mid ports 218 extending laterally therethrough a short distance from its upper end and a second set of mid ports 220 extending laterally therethrough near its lower end. The next lower spacer member 206 of the outer assembly is likewise a thick-walled member, whose inner diameter, over the major portion of its length, is slightly less than that of member 204 thereabove. Member 206 has respective internal upsets 222 and 224 adjacent its upper and lower ends, these upsets being sized for a sliding fit on member 214 of the inner assembly. In the inflation position shown, slots 216 of inner member 214 are located intermediate upsets 222 and 224. The upsets carry respective seal rings 226 and 228 which seal against the outer diameter of inner member 214 and thereby isolate slots 216 from communication with the variour mid ports of the outer assembly in the inflation position. Member 206 also has external wrench formations 230 for convenient handling. The next section 208 of the outer assembly is a relatively thin-walled member defining two sets of lateral mid ports 232 and 234 near its upper and lower ends respectively. Member 210 connected to the lower end of member 208 is a non-ported thick-walled member having upsets 236 and 238 near its upper and lower ends, the upsets carrying respective seal rings 240 and 242 slidably sealing engaging the exterior of inner assembly member 214. By comparison of FIGS. 2F and 2G, it can be seen that mid ports 232 and 234 are, in the inflation position, isolated between seals 228 and 240 along a non-ported portion of member 214.

Figure 2H:
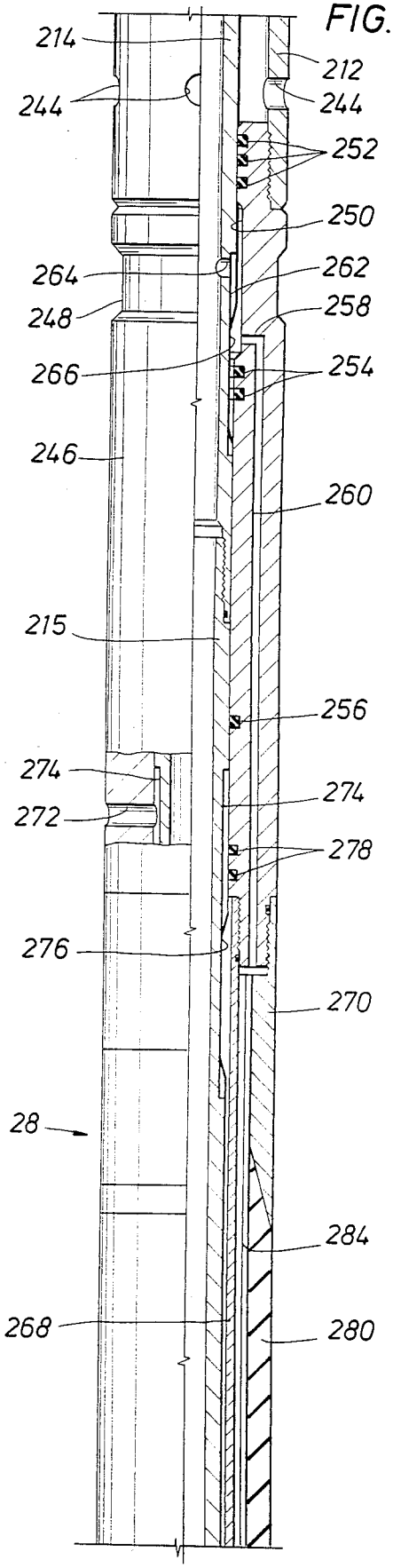

Referring next to FIG. 2H, the lower end of member 212 defines still another set of lateral mid ports 244. Just below these ports, member 212 is threadedly connected to the next adjacent member 246 of the outer assembly. Member 246 is an extension of lower packer 28. With certain minor exceptions, such as the diameters of various parts, lower packer 28 and related parts are substantially identical in structure and function to upper packer 24 and its corresponding related parts. Near its upper end, section 246 has a necked-down area 248 for convenience in handling. On the interior of its upper end, generally aligned with necked down area 248, section 246 has a shallow annular recess 250. Above recess 250, section 246 carries a set of three seal rings 252 sized to sealingly engage the major diameter of section 214 of the inner assembly. One of seals 252 may be a wiper, and the other two packing type seals. Below recess 250, section 246 carries a set of two seal rings 254, likewise sized to seal against the major diameter of section 214 of the inner assembly. Spaced below seals 254, is still another seal ring 256, also sized to seal against the major diameter portion of section 214 of the inner assembly. The lower end of section 214 of the inner assembly is connected to section 215. Section 215, having inner and outer diameters equal to those of section 214, in essence, simply forms an extension or continuation of section 214.

Intermediate seals 252 and 254, and communicating with recess 250, is the inlet 258 of the packer set chamber of lower packer 28. Inlet 258 intersects an offset longitudinal bore 260 in secton 246, bore 260 comprising an upper portion of the packer set chamber. Seals 252, located longitudinally on one side of inlet 258 serve as the first packer seals; seals 254, located longitudinally on the opposite side of inlet 258 from seals 252, serve as the second packer seals; and seal 256, located across seals 254 from inlet 258, serves as the auxiliary packer seal for lower packer 28.

The portion of section 214 of the inner assembly which lies generally adjacent the upper end of section 246 of the outer assembly in the inflation position has a set of circumferentially spaced longitudinal slots, one of which is shown at 262 cut into its outer surface. Near its upper end, slot 262 is intersected by the packer set port 264 for lower packer 28. Below port 264, but in communication with slot 262, section 214 of the inner assembly has a reduced outer diameter area or undercut 266. With the apparatus in its inflation position, packer set port 264 communicates via slot 262, undercut 266 and recess 250 with inlet 258 of the packer set chamber. Second packer seals 254, being in register with undercut 266, do not sealingly engage section 214 of the inner assembly. However, first packer seals 252 and auxiliary packer seal 256 do sealingly engage between section 246 of the outer assembly and sections 214, 215 of the inner assembly on opposite sides of the generally open area defined by port 264, slot 262, recess 250, undercut 266 and inlet 258. Thus, pressurized fluid from port 264 may be pumped into inlet 258, and due to the presence of slot 262 and undercut 266, the pressure above and below seals 254 will be equal during inflation.

The lower end of section 246 of the outer assembly has an external thread sealingly connected to upper packer head 270 as well as an internal thread sealingly connected to the upper end of packer mandrel 268. Above these threaded connections to the packer proper, section 246 is provided with at least one radial bore 272, circumferentially offset from bore 260 of the packer set chamber. Bore 272 is the lowermost mid port of the outer assembly. In the inflation position, bore 272 is aligned with and communicates with at least one of a series of longitudinal slots 274 cut into the exterior of section 215 of the inner assembly and spaced circumferentially from one another. Intermediate their ends, slots 274 are communicated with one another by a reduced diameter section or undercut 276. Seal rings 278 carried by section 246 just above its lower threaded connections to the packer proper, and sized to engage the major diameter portions of sections 214 and 215 of the inner assembly, are in register with slots 274. Slots 274, undercut 276, and bore 272 form a part of a pressure relief bypass system for the lower packer.

Bore 260 extends through the lower end of section 246 to communicate with the major portion of the packer set chamber defined by the annular spaced between mandrel 268, on the one hand, and head 270 and the attached elastomeric packer body 280, on the other hand. The upper end of elastomeric packer body 280 is secured to head 270. Reinforcing layer 284 is bonded to body 280.

Figure 2I:
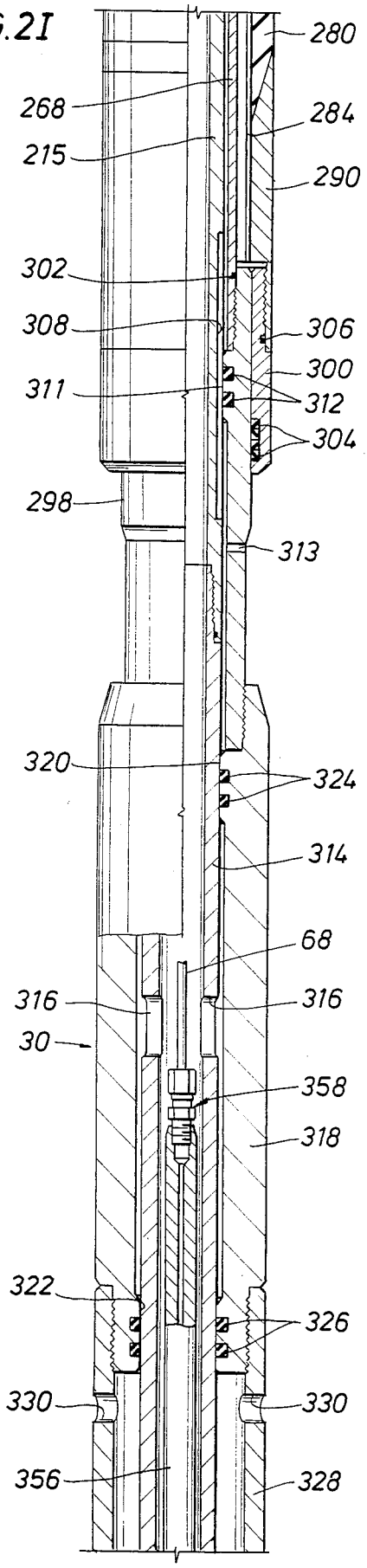

Referring to FIG. 2I, the lower end of packer body 280 is similarly secured to a lower packer head 290. The lower packer head is movable with respect to mandrel 268. Mandrel 268 is threadedly connected to the next adjacent section 298 of the apparatus, while head 290 is threadedly connected to a guide member 300 slidably surrounding section 298. The lower end of the packer set chamber is closed off by: seal 302, sealing between mandrel 268 and section 298; sliding seals 304, sealing between guide member 300 and member 298; and O-ring 306 sealing between guide member 300 and lower packer head 290. Near the lower end of packer 28, section 215 of the inner assembly has a plurality of circumferentially spaced longitudinal slots, one of which is shown at 308, formed in its outer surface. In the inflation position as shown, seal rings 312 carried on upset 311 near the upper end of section 298 of the outer assembly are positioned adjacent slots 308. With the exception of upset 311, the inner diameter of member 298 is sized to clear inner assembly members 215 and 314. A radial bore 313 through member 298 is the upper most of the lower ports of the outer assembly and also serves as a part of the lower bypass to be described below.

Section 215 of the inner assembly terminates shortly below slots 308 where it is threadingly and sealingly connected to section 314. Section 314 has inner and outer diameters, along a major portion of its length, equal to those of sections 215 and 214 thereabove. Near its upper end, section 314 is interrupted by a set of lateral slot-shaped ports 316 forming still another part of the fluid passage means of the inner assembly. Section 298 of the outer assembly is a relatively short sub which is threadedly connected to the next adjacent section 318 of the outer assembly. Section 318 is a relatively thick-walled section having internal upsets 320 and 322 adjacent its upper and lower ends and sized for a sliding fit on section 314 of the inner assembly. Upsets 320 and 322 carry respective pairs of seal rings 324 and 326 which sealingly engage section 314 of the inner assembly on opposite longitudinal sides of ports 316 in the inflation position.

Figure 2J:
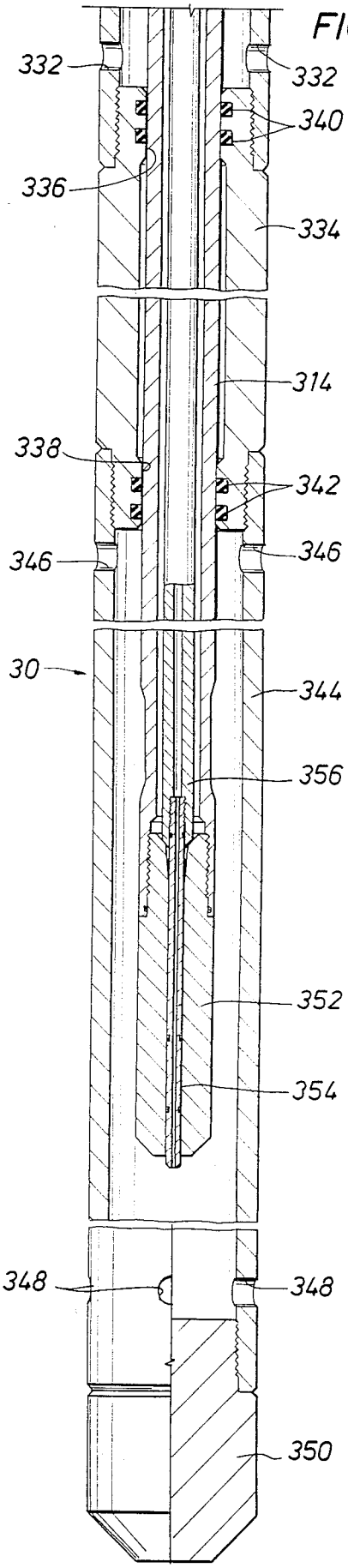

Referring now to FIG. 2J in conjunction with FIG. 2I, section 318 of the outer assembly is threadedly connected to a relatively thin-walled section 328 which defines two longitudinally spaced sets of lower ports 330 and 332 respectively. Section 328 is in turn threadedly connected to another thick-walled section 334, similar to section 318. Section 334 has upsets 336 and 338 adjacent its upper and lower ends carrying respective seal rings 340 and 342 for sealingly engaging the outer diameter of section 314 of the inner assembly. Section 334 is threadedly connected to another thin-walled section 344, similar to section 328, and including longitudinally spaced sets of lower ports 346 and 348. The lower end of section 344 is connected to a solid plug or nose piece 350.

The lower end of section 314 of the inner assembly is threadedly connected to a seat 352 for sealingly receiving a sensor probe 354 which protrudes through the lower end of the seat. Probe 354 is exposed to the environment in the well below the lower packer through the lower end of seat 52, the space between the inner and outer assemblies, and lower ports 348. Connected to the upper end of probe 354 is a tubular weight or sinker bar 356 which in turn has its upper end connected by a fitting 358 to the sensor line 68 described hereinabove. Both probe 354 and weight 356 have small diameter central bores by which fluids from the well environment below the lower packer may be communicated into and through line 68 to instrument unit 64 (See FIG. 1A).

Referring now to FIGS. 2A–2J jointly, in assembling the overall apparatus, the outer assembly would first be made up and suspended from a clamp or the like at the rotary table of a drilling rig. Next, the inner assembly would be made up and, as assembled, lowered into the outer assembly. During this operation, the inner assembly would be supported on a more or less conventional clamp. When tapped bores 98 are in alignment with slots 36, lugs 34 are inserted to interconnect the inner and outer assemblies. The outer assembly can then be supported on lugs 34 at shoulders 73 and the clamp previously supporting the outer assembly can be removed. At any suitable point in the operation, sensor line 68 may be run into the inner assembly. Probe 354 will stab into and seal against seat 352. The apparatus is then run into the well, preferably in the inflation position shown in FIGS. 2A–2J. Then, when the tool reaches the desired depth, the packers 24 and 28 can be inflated without the need for manipulation of the tool.

More specifically, in the inflation position, the fluid passage means of the inner assembly are in communication with the packer set chambers but are blocked from communication with any of the lateral ports spaced along the length of the outer assembly. As shown in FIG. 2C, the uppermost set of ports 130 in the inner assembly is isolated between seals 122, on the one hand, and seal 128, on the other hand, adjacent a non-ported portion of the outer assembly, specifically along the upper end of section 23. Conversely, the lateral openings formed by slots 36 of the outer assembly are isolated from communication with any of the lateral ports in the inner assembly by seals 122, and upper ports 114 and 116 of the outer assembly are isolated between seal 128 and seals 140 in alignment with a non-ported section of the inner assembly.

Packer set port 154 through the inner assembly communicates via slots 150, recess 138, and/or undercut 152, with the inlet 146 of the packer set chamber of upper packer 24. Port 154 is blocked from communication with any of the other lateral ports in the outer assembly by first packer seals 140 and auxiliary packer seal 144. Thus, with lugs 34 engaging shoulders 73, and valve assembly 38 in the open position, pressurized fluid pumped into operating string 18 and through port 154 will be forced to enter inlet 146 whereby packer 24 may be inflated.

The next set of lateral ports in the inner assembly are ports 216 formed in section 14. These ports 216 are isolated along non-ported section 206 of the outer assembly by seals 226 and 228, and thereby blocked from communication with any of the lateral ports of the outer assembly. Mid ports 218 and 220 of the outer assembly, located in section 204 above section 206 and ports 216, form a part of the bypass system to be discussed hereinbelow. Briefly, these ports are blocked from communication with any of the lateral ports of the inner assembly by seals 226 below the ports and by auxiliary packer seal 144 above the ports. Two additional sets of mid ports, ports 232 and 234 on section 208 of the outer assembly, are isolated between seals 228 and 240 on a non-ported area of the inner assembly. Still another set of mid ports, 244 at the lower end of section 212 of the outer assembly, are isolated between seals 242 on section 210 thereabove and first packer seals 252 therebelow, likewise along a non-ported portion of the inner assembly.

Second packer set port 264 communicates with inlet 258 of the packer set chamber of lower packer 28 in substantially the same manner as the corresponding parts with respect to upper packer 24. More specifically, both port 264 and inlet 258 are located between first packer seals 252 and auxiliary packer seal 256, and thereby blocked from communication with others of the lateral ports of the outer assembly, but communicate with each via slots 262, undercut 266, and/or recess 250. Thus, the pressurized fluid being pumped through the operating string and into the inner assembly of the tool will be permitted to inflate both upper and lower packers virtually simultaneously.

The last set of lateral ports of the inner assembly comprises ports 216 in section 214. These ports are isolated between seals 324 and 326 along non-ported section 318 of the outer assembly, and thereby blocked from communication with any of the lateral ports of the outer assembly. It may be noted that the longitudinal bore through seat 52 does not effectively constitute part of the fluid passage means of the inner assembly because probe 354 is sealed with respect to that bore, and the interior bore of probe 354 and the connected bores of weight 356 and line 68 are isolated from direct communication with the interior of the inner assembly.

The various sets of lower ports of the outer assembly, namely ports 330, 332, 346 and 348, are all effectively isolated from communication with any of the lateral ports of the inner assembly by seals 326 (although ports 346 and 348 are further isolated by seals 340 and 342).

Accordingly, in the inflation position, there is no communication between the lateral ports of the inner and outer assemblies. Only the two packer set ports 264 and 154 permit any substantial fluid flow therethrough, and this flow is communicated, not to any of the full lateral ports in the outer assembly, but only to the respective upper and lower packer set chambers.

Once the upper and lower packers have been inflated to engage and seal against the well bore, such engagement retains the outer assembly in a fixed longitudinal position in the well, whereby the inner assembly may be manipulated with respect to the outer assembly to move the tool to various other operating positions. In a typical operating sequence, as the tool is being moved from the inflation position to either of the two alternative flow positions, it will automatically pass through an equalizing position whereby the pressures in the three well zones separated by the packers are equalized. However, prior to assumption of the equalizing position, and specifically during inflation of the packers, it is extremely undesirable to permit excessive pressures to be trapped between the two packers or below the lower packer. Indeed, such excessive pressures might even affect proper operation of the packers. Accordingly, bypasses are provided to allow relief of pressures below and between the packers in the inflation position.

As to the portion of the well below lower packer 28, and referring to FIG. 2I, pressurized fluid may pass through port 313 in member 298 of the outer assembly into the clearance between that member and adjacent members 314 and 215 of the inner assembly. From this clearance, the fluid will pass into slots 308 so that it can bypass seals 312 and move up into the clearance between section 215 of the inner assembly and mandrel 268 of the lower packer. From the latter clearance, the fluid passes into slots 274. Undercut 276 communicates all slots 274 with one another so that the fluid will pass into whichever one of the slots is aligned with bore 272. Through bore 272, the fluid passes back into the well bore annulus in the zone between the two packers. It is noted that the fluid thus bypasses lower packer 28, but without being permitted to communicate with any of the lateral ports of the inner assembly. Note, in particular, that bore 272 is isolated by seal 256 and seals 324 (FIG. 2I) along a non-ported portion of the inner assembly and thereby blocked from communication with the fluid passage means of the inner assembly.

Any fluid of excess pressure tending to be trapped between the two packers, whether already present in that area or having passed into the area through the last described lower bypass system, can similarly bypass the upper packer through another bypass system. In particular, such fluid may enter the area between the inner and outer assemblies through either mid ports 220 or mid ports 218 of the outer assembly. Both of these sets of ports communicate with a clearance between section 204 of the outer assembly and sections 214 and 202 of the inner assembly. The next adjacent section 186 of the outer assembly likewise provides a clearance with enclosed section 202 of the inner assembly. The latter clearance is, to a lesser extent, present even at internal upset 201 of section 186. However, slots 196 ensure and facilitate bypassing of seals 200 in upset 201 by the fluid. Undercut 198 distributes this fluid through all of the slots 196. From slots 196, the fluid enters the clearance between members 202 and 132 of the inner assembly, on the one hand, and mandrel 156, on the other. Then, the fluid enters slots 162 so that it may bypass seals 166. Undercut 164 ensures that the fluid communicates with all slots 162, including the one aligned with bore 160. From bore 160, the fluid passes into the upper portion of the well, above upper packer 24. Seal 144 and seals 226 isolated bore 160 from communication with the interior of the inner assembly through its lateral ports.

After packers 24 and 28 have thus been inflated, pump pressure is held on the interior of the inner assembly while that assembly is lowered. When the inner assembly has been lowered by a predetermined amount, at which time lugs 34 will be located in runs 72 of slots 36 some distance below shoulders 73 but above pockets 74, the tool will have automatically assumed an equalizing position. Such an equalizing position is illustrated in FIGS. 3A–3F. Although, for convenience, reference will be had herein to an equalizing "position," the apparatus actually continues to operate in an equalizing mode throughout a continuous series of positions as the inner assembly continues to move downwardly. FIGS. 3A–3F thus represent one of this series of equalizing positions. In the equalizing positions, the fluid passage means of the inner assembly are in communication with lateral ports through the outer assembly above upper packer 24, between packers 24 and 28, and also below lower packer 28. Thus, the pressures in these three zones of the well are permitted to equalize prior to testing or other operations to be performed in the flow positions to be described hereinbelow. Also in at least the lower equalizing positions, the bypasses are closed, and the packer set chambers are sealed off with respect to the exterior of the inner assembly. When such position is reached, pump pressure is relieved from the interior of the inner assembly, and the packers will remain inflated as the inner assembly is further lowered.

Figure 3A:
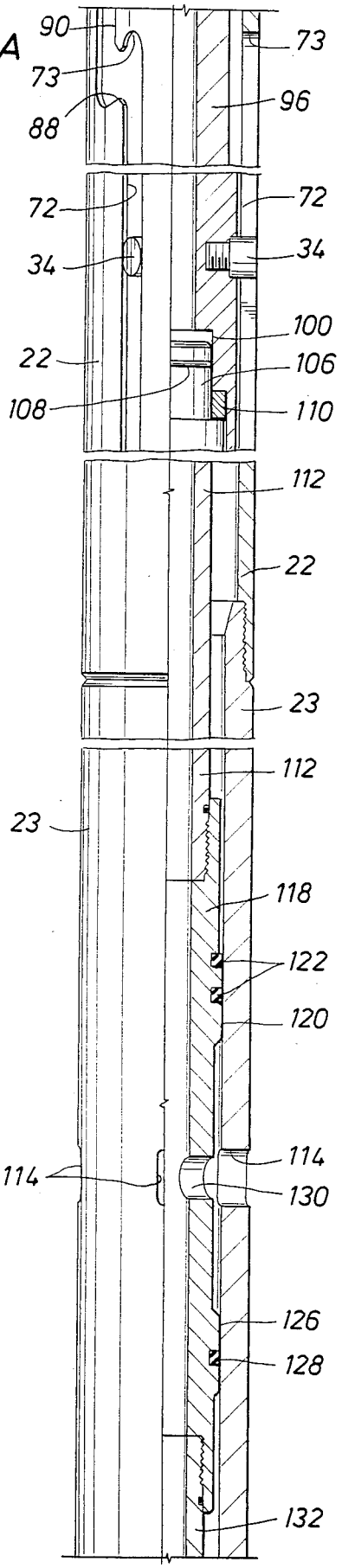
FIGS. 3A–3F are quarter-sectional views of selected progressively lower portions of the apparatus in the equalizing position.

Referring first to FIG. 3A, ports 130 of the inner assembly are still isolated between seals 122 and 128, but these seals have moved downwardly to positions respectively above and below upper ports 114 of the outer assembly. Thus, the interior of the inner assembly may communicate with the upper zone of the well, above packer 24, through communicating ports 130 and 114.

Figure 3B:
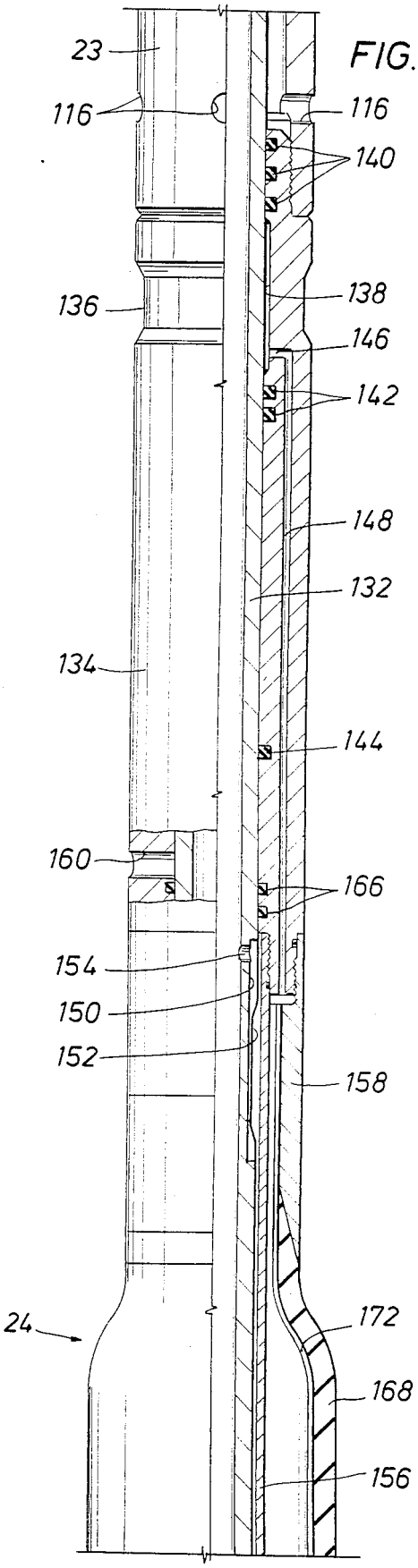

Referring next to FIG. 3B, packer set port 154 has moved downwardly beyond seals 142, 144, and 166 so that it no longer communicates with inlet 146 of the packer set chamber of upper packer 24. Furthermore, inlet 146 is isolated between first and second packer seals 140 and 142 respectively against a non-ported portion of the inner assembly. Thus, the fluid which inflated packer 24 is trapped therein so that the packer is held in its inflated condition. Referring once again to FIG. 2D, it will be recalled that, during inflation of the packer, due to the presence of slots 150, there was no pressure differential across second packer seals 142, and auxiliary packer seal 144 was relied upon to seal between the inner and outer assemblies below the communicating packer set port 154 and inlet 146. Then, as the inner assembly is moved downwardly from the position of FIG. 2D to the position of 3B, the edges at the upper extremities of slots 150 will move past second packer seals 142, but not in the presence of a pressure differential. This minimizes potential damage to seals 142, which must hold the inflation pressure during subsequent operations. Auxiliary packer seal 144 is a more readily expendable seal.

Figure 3C:
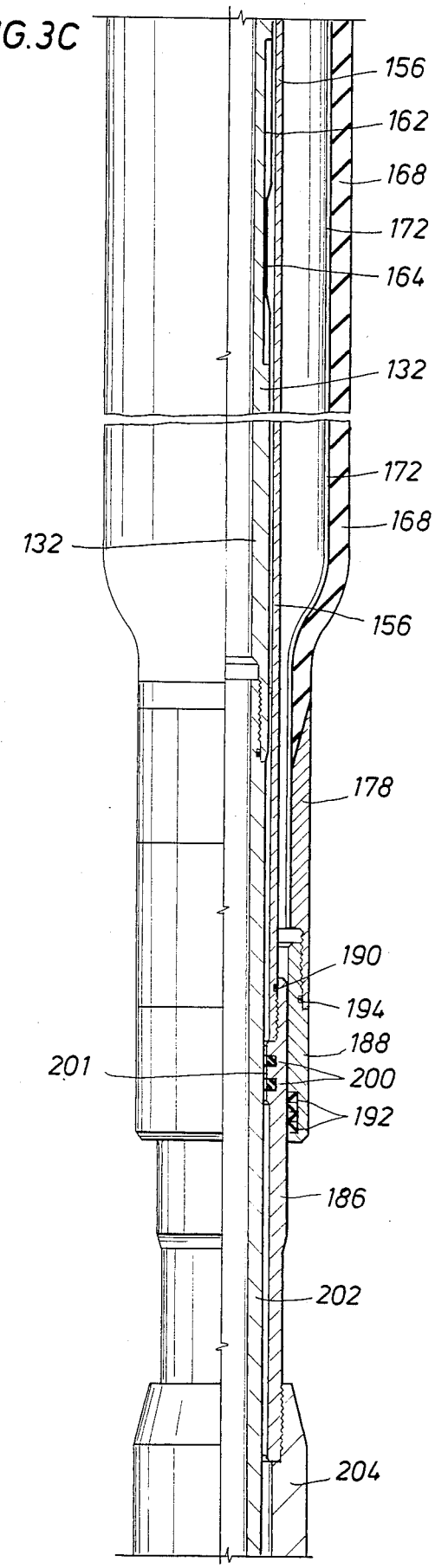

As shown in FIG. 3C, while upset 201 is still aligned with section 202 of the inner assembly, a clearance still exists at seals 200. However, the next adjacent (upward) section 132 of the inner assembly is of slightly larger outer diameter. As the inner assembly continues moving downwardly, and section 132 comes into alignment with upset 201, the two will be sealed with respect to each other by seals 200, the upper bypass will be closed, and packer set port 154 will be isolated between seals 166 and 200 and blocked from communication with any of the lateral ports of the outer assembly.

Figure 3D:
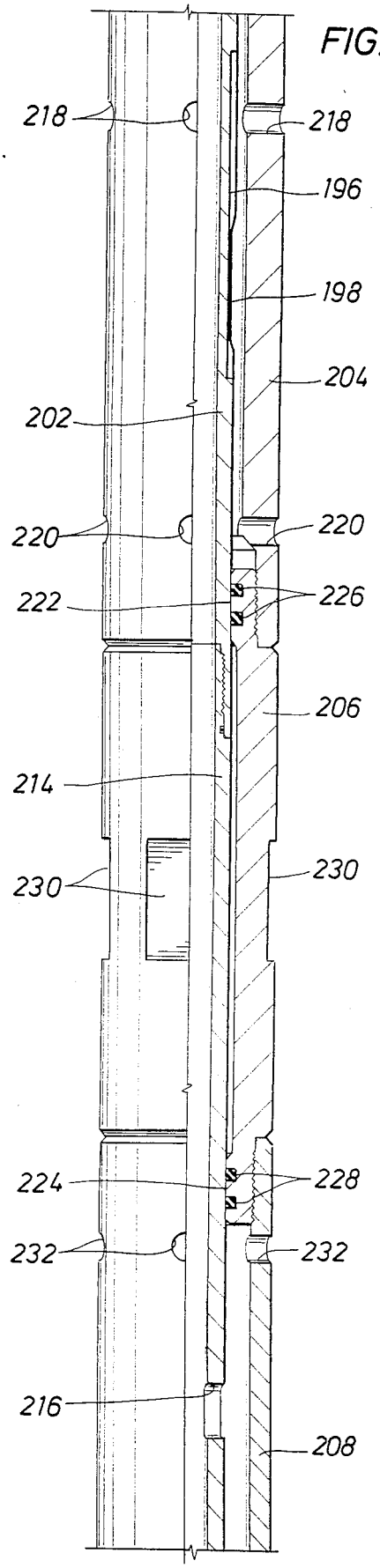

Referring next to FIG. 3D, it can be seen that ports 216 of the inner assembly have come into alignment with section 208 of the outer assembly whereby they may communicate with mid ports 232 and 234 (not shown) of the outer assembly located between packers 24 and 28. Thus, the middle zone of the well is in communication with the interior of the inner assembly of the tool.

Figure 3E:
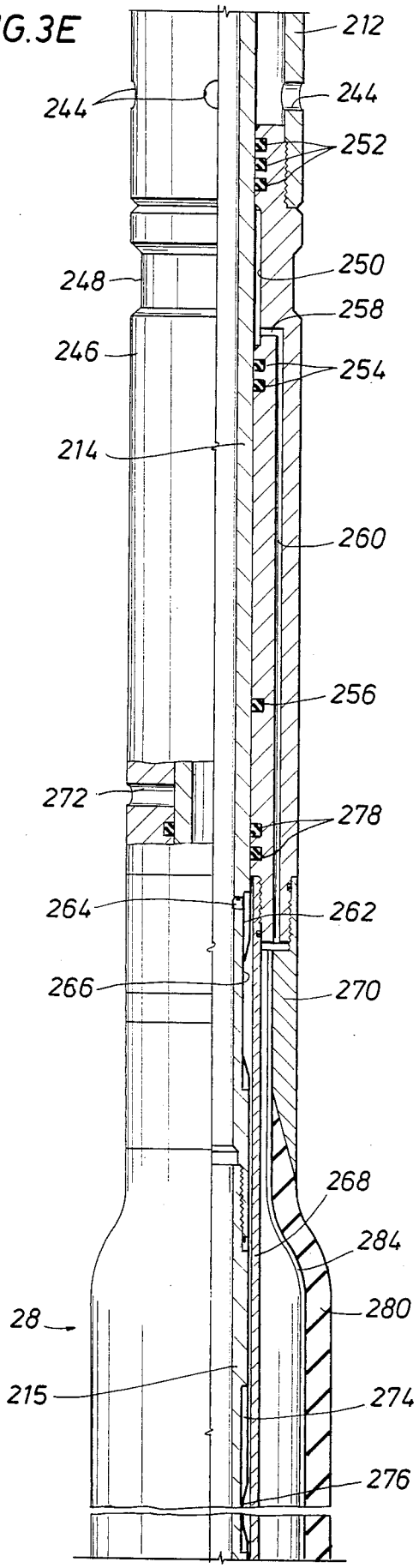
Figure 3F:
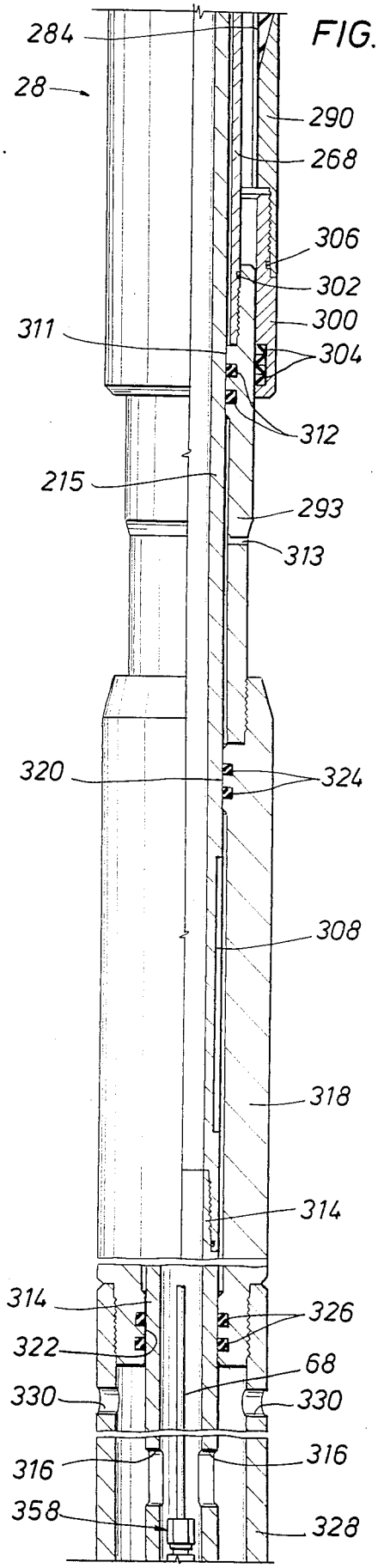

Referring next to FIGS. 3E and 3F, lower packer 28 and related parts are in a similar condition to the corresponding parts of the upper packer, except that the lower bypass has already been closed. Specifically, inlet 258 of the packer set chamber is isolated between seals 252 and 254 along a non-ported portion of the inner assembly. Packer set port 264 has moved downwardly out of communication with inlet 258 and, more specifically, is isolated from communication with any of the lateral ports in the outer assembly by seals 278 and 312. The latter seals likewise close the lower bypass by sealing against section 215 of the inner assembly to block fluid tending to flow upwardly between the two assemblies from port 313.

Finally, FIG. 3F shows that ports 316 of the inner assembly have been brought into communication with lower ports 330 of the outer assembly whereby the lower zone of the well is communicated with the interior of the inner assembly. In summary, each of the three zones of the well, located respectively above, between and below the two packers, communicates with the interior of the inner assembly by means of communicating ports in the inner and outer assemblies, whereby these three well zones communicate with one another and the pressures therein may be equalized.

When the inner assembly has been lowered a predetermined distance to align lugs 34 with pockets 74 of slots 36, the inner assembly is rotated counterclockwise to bring lugs 34 into pockets 74. Such positioning of the lugs determines a lower flow position wherein the packers remain set and sealed and the interior of the inner assembly is communicated only with the lower well zone below packer 28, but not with the zone between the packers nor the zone above upper packer 24. With the apparatus generally in this lower flow position, if the operating string is placed in tension to bring lugs 34 into abutment with shoulders 76, an open position of valve 38 is determined or ensured, and fluid may be pumped into or withdrawn from the lower well zone through the operating string 18. Such flow may be stopped, without removing the tool itself from a general lower flow configuration, by setting down on the operating string to bring lugs 34 into engagement with shoulders 78 and shoulder 50 into abutment with formation 46 in valve 38.

Figure 4A:
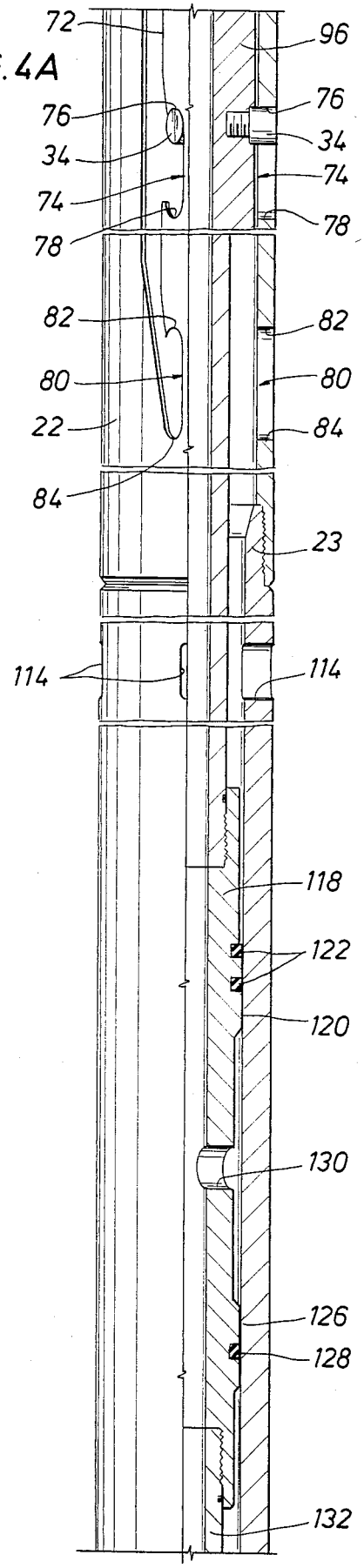
FIGS. 4A–4F are quarter-sectional views of selected progressively lower portions of the apparatus in the lower flow position.
Figure 4B:
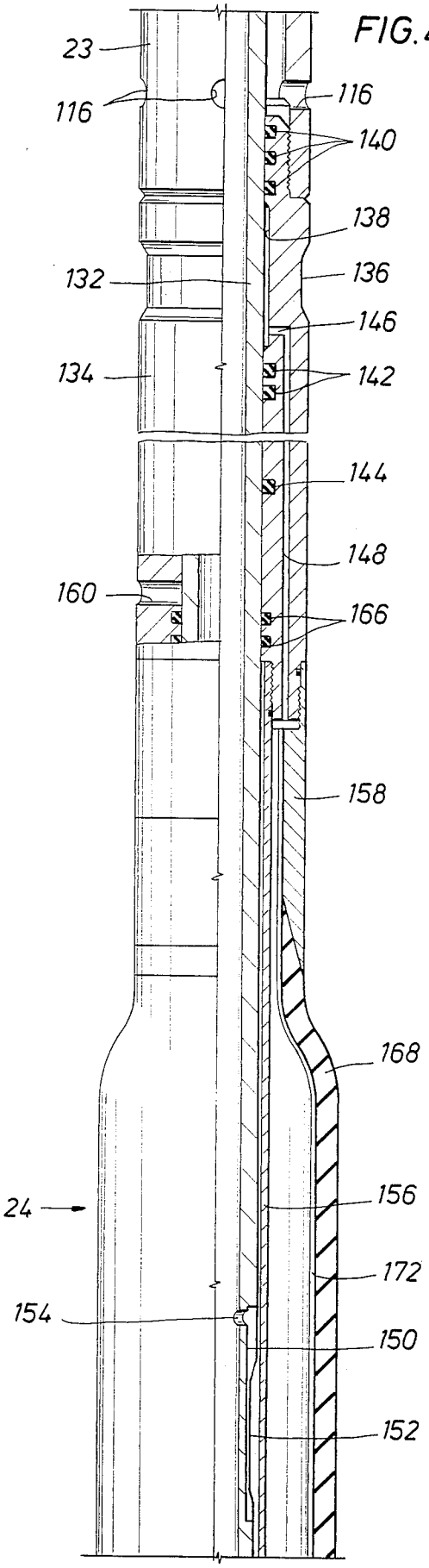
Figure 4C:
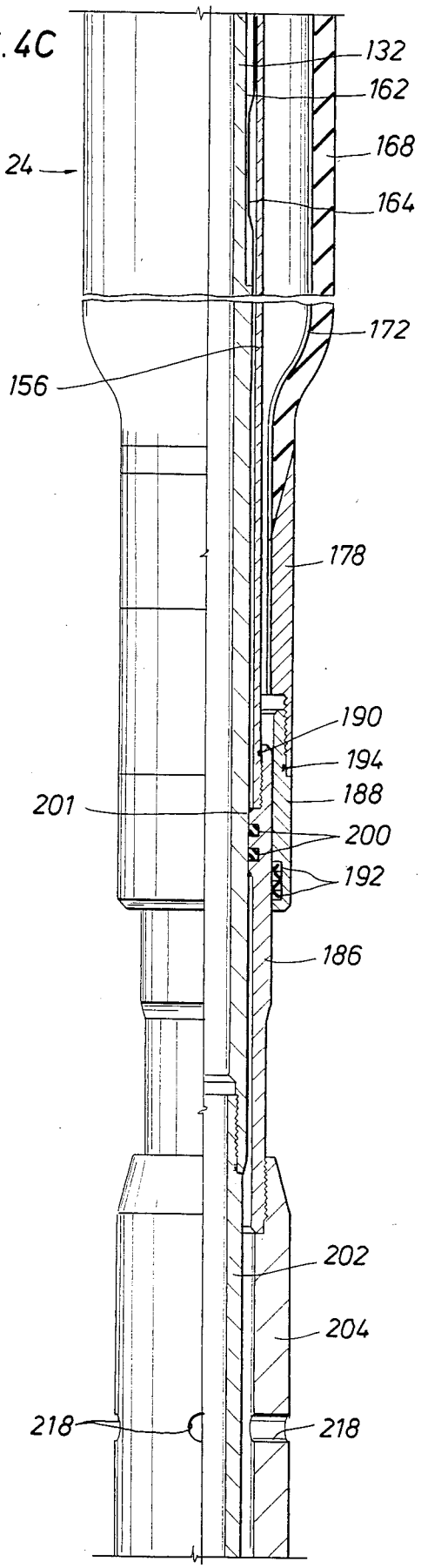

The lower flow position of the straddle packer apparatus is more specifically illustrated in FIGS. 4A–4F. Referring to FIG. 4A, it can be seen that, in the lower flow position, ports 130 have been moved below upper ports 114 of the outer assembly and are sealed against a non-ported portion of the outer assembly between seals 122 and 128, and thereby isolated from communication with any of the lateral ports of the outer assembly. Referring jointly to FIGS. 4B and 4C, it can be seen that the upper bypass has been closed, and in the lower flow position, remains closed, by engagement of seals 200 on upset 201 with section 132 of the inner assembly. Thus, packer set port 154 is isolated between seals 200 and seals 166 and thereby blocked from communication with any of the lateral ports of the outer assembly. It can also be seen that the portion of section 132 of the inner assembly which is aligned with inlet 146 of the packer set chamber, i.e. the portion between seals 140 and seals 142, is non-ported, as are successive lengthwise portions of member 132 across port 160 and down to packer set port 154. Thus, upper packer 24 will have remained sealed in its set condition as the apparatus was moved from the equalizing position of FIGS. 3A–3F to the lower flow position of FIGs. 4A–4F.

Figure 4D:
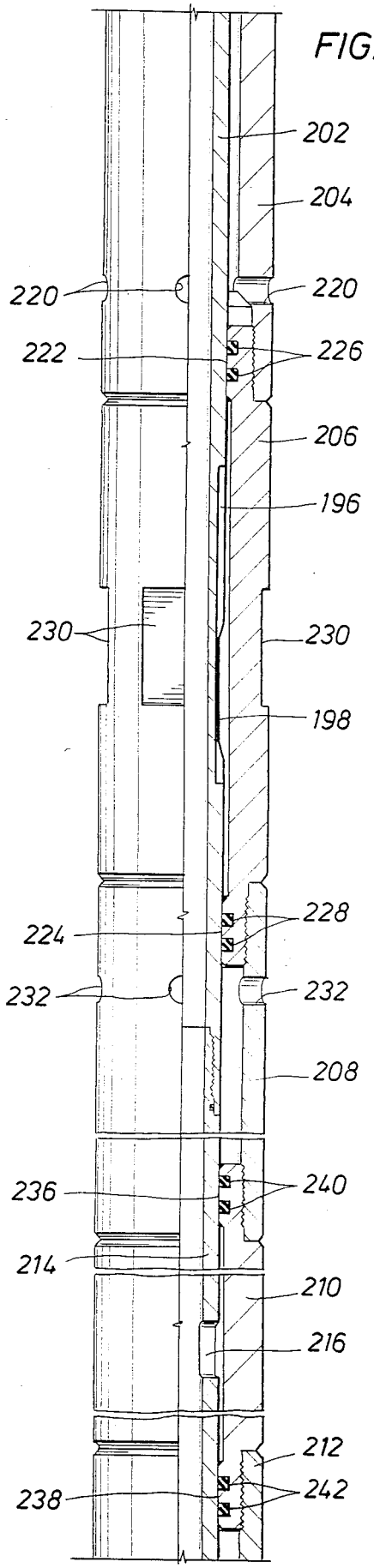

Referring to FIG. 4D, ports 216 of the inner assembly are isolated between seals 240 and 242 on non-ported outer assembly member 210 and thereby blocked from communication with any of the lateral ports of the outer assembly and, more specifically, with the various nearby mid ports of the outer assembly located between packers 24 and 28, e.g. ports 232, 234, and 244.

Figure 4E:
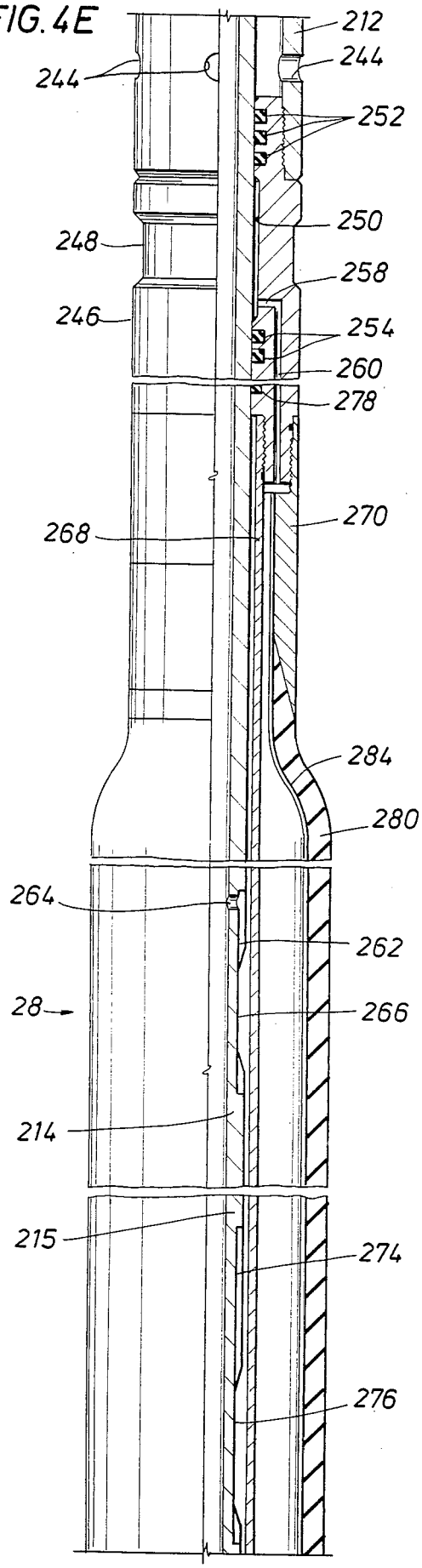
Figure 4F:
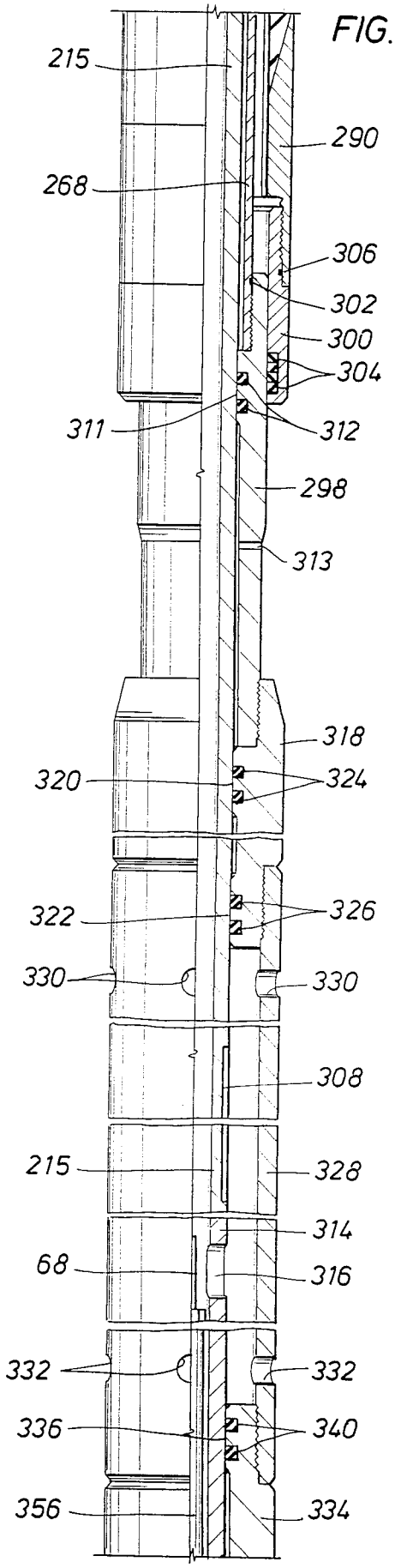

Referring next to FIGS. 4E and 4F, the condition of the lower packer 28 is substantially the same as that of the upper packer 24. Specifically, in moving the apparatus from the equalizing position to the lower flow position, packer seals 252 and 254 will have been in continuous engagement with non-ported portions of secton 214 of the inner assembly to maintain the lower packer sealed in its set condition by blocking inlet 258. Likewise, the packer set port 264 remains isolated between seals 312 (near the lower end of the packer) and seals 278 (shown in FIGS. 3E and 2H) and thereby blocked from communication with any of the lateral ports of the outer assembly.

Finally, still referring to FIG. 4F, it can be seen that ports 316 of the inner assembly, still located between seals 326 and 340 adjacent member 328 of the outer assembly, may communicate with various of the lower port means of the outer assembly, specifically ports 330 and 332, to permit testing or other operations as described hereinabove. During these operations, all of the lateral ports of the inner assembly other than port 316 remain blocked from communication with the various lateral ports in the outer assembly, so that communication with the interior of the inner assembly is provided only with that zone of the well located below lower packer 28. As mentioned, as the apparatus is moved into and remains in the lower flow position, the packers are maintained in their set condition and the bypasses are closed.

If it is desired to perform similar testing or other operations on that zone of the well located between upper and lower packers 24 and 28, while blocking the interior of the inner assembly from communication with the other zones of the well above the upper packer and below the lower packer, the inner assembly is rotated in a clockwise direction to remove lugs 34 from pockets 74 of slots 36. The inner assembly is then further lowered. When lugs 34 reach inclined surfaces 88 at the lower ends of slots 36, they will be directed into lower pockets 80 by virtue of counterclockwise rotation of the inner assembly. This positioning of lugs 34 determines, in general, a mid flow position of the apparatus. Engagement of shoulders 82 by the lugs will determine an open condition of valve 38. While engagement of shoulders 84 would determine a closed valve condition, preferably downward movement of the inner assembly is stopped, and the closed valve condition is determined by shouldering of sub 92 on sub 20 (See FIG. 5A). During the movement of the apparatus from the lower flow position to the mid flow position, both packers 24 and 28 are automatically held sealed in their set conditions, and the bypasses associated with the packers are continuously closed.

Figure 5A:
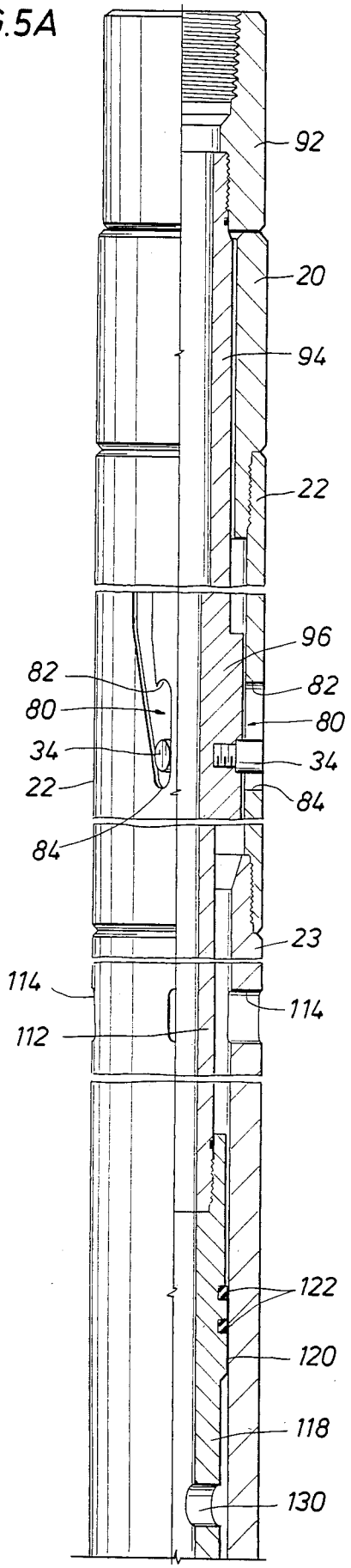
Figure 5B:
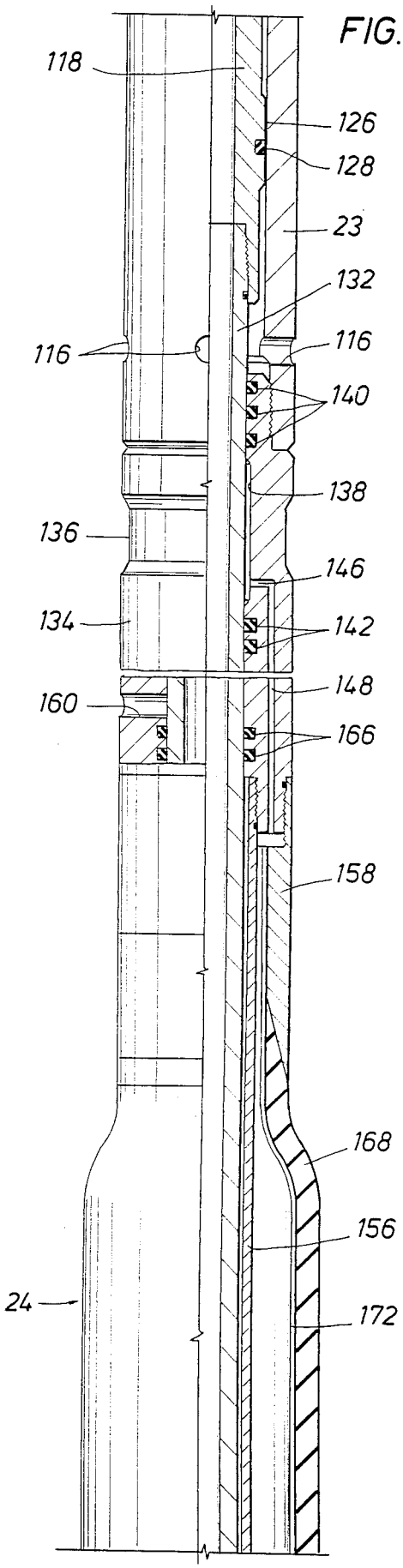
Figure 5C:
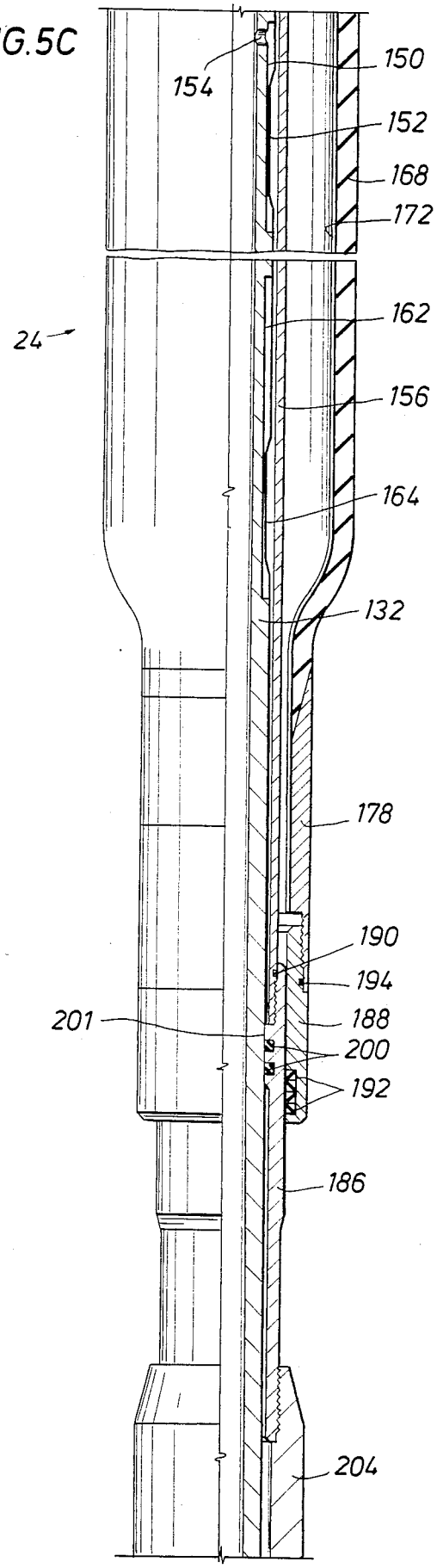

The mid flow position is shown in detail in FIGS. 5A–5F. Referring to FIGS. 5A and 5B, ports 130 of the inner assembly and their isolating seals 122 and 128, having passed along and continue to remain in alignment with a continuous non-ported portion of the outer assembly in moving from the lower flow to the mid flow positions. Thus, ports 130 have remained constantly blocked from communication with any of the lateral ports of the outer assembly. Similarly, the portions of member 132 of the inner assembly which have passed the area between packer seals 140 and 142 of the upper packer are continuous and non-ported, whereby inlet 146 of the upper packer set chamber is constantly sealed. Referring now also to FIG. 5C, packer set port 154, while having moved downwardly, is still isolated between seals 166 and 200 and blocked from communication with any of the lateral ports in the outer assembly. Seals 200 will likewise have continuously kept the upper bypass associated with packer 24 in its closed state.

Figure 5D:
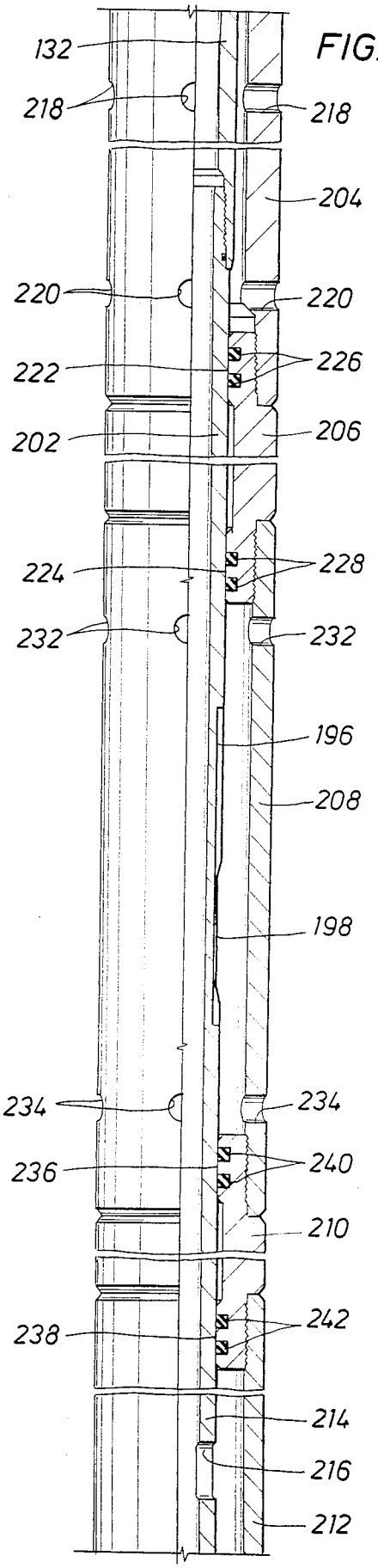

Referring now also to FIGS. 5D and 5E, mid ports 218 and 220 of the outer assembly remain isolated between seals 226 and 200 along a non-ported portion of the inner assembly, and mid ports 232 and 234 likewise remain isolated between seals 228 and 240 along a non-ported portion of the inner assembly. However, the lowermost set of mid ports 244 is now in communication with ports 216 of the inner assembly, which have been moved into alignment with section 212 of the outer assembly, between successive sets of seals 242 and 252. By means of communicating ports 216 and 244, the interior of the inner assembly is communicated with the well annulus between the two packers 24 and 28, while seals 242 and 252 prevent ports 216 of the inner assembly from communicating with other lateral ports of the outer assembly, either above or along the upper packer 24 or along or below the lower packer 28.

The portion of section 214 of the inner assembly which is in alignment with inlet 258 of the lower packer set chamber, in the area between packer seals 252 and 254, is non-ported, as are all portions of that section which would have passed the area between seals 252 and 254 during movement of the apparatus from the lower flow position to the mid flow position. Thus, lower packer 28 will have been maintained in its set condition. Likewise, packer set port 254 will have remained isolated between seals 312 and seals 278, and thereby blocked from communication with the various lateral ports of the outer assembly.

Referring finally to FIG. 5F, it can be seen that ports 316 of the inner assembly have been lowered into alignment with non-ported section 334 of the outer assembly, and is thus isolated between seals 340 and 342 and thereby blocked from communication with any of the lateral ports of the outer assembly and, specifically, from communication with any of the lateral ports below lower packer 28.

The apparatus can be moved from the lower flow position to the mid flow position and back again as many times as desired without deflation of packers 24 and 28. However, if it is desired to move the overall apparatus to a different position in the well, the inner assembly is simply rotated clockwise until lugs 34 are located in runs 72, and then raised until lugs 34 engage shoulders 73 to return the apparatus to its inflation position. This will bring packer set ports 254 and 264 back into communication with respective inlets 146 and 258 of the packer set chambers. Then, by relieving the fluid pressure within the interior of the inner assembly, the packers may be deflated and the apparatus moved. When the apparatus is located at the desired point in the well, the packers may then be reinflated by simply repeating the procedure described hereinabove for initial inflation. Operations may then be performed on the zone of the well isolated between the two packers or, alternatively, on the zone of the well located below the lower packer. Such inflations and deflations of the packers, movements of the apparatus, and alternate operations on lower and mid zones of the well may all be performed without ever removing the tool and its operating string from the well and are effected by relatively simple movements of the inner assembly without the need for complicated procedures.

While the apparatus could be removed from the well by returning the tool to the inflation position, relieving pump pressure to allow the packers to deflate, and then withdrawing the tool, if it is known that the tool will be completely removed from the well, it is preferable to move the apparatus into its pull out position, wherein the packer set chambers vent directly into the well bore, rather than into the interior of the inner assembly. Thus, the pull out position prevents accidental inflation of the packers as the apparatus is pulled from the well and, consequently, prevents swabbing and/or damage to the packers by virtue of moving contact with the well bore. However, once the tool has been placed in the pull out position, it cannot be returned to the inflation position downhole. Thus, the pull out position is preferably assumed only if it is definitely determined that the apparatus should be completely removed from the well.

Figure 6A:
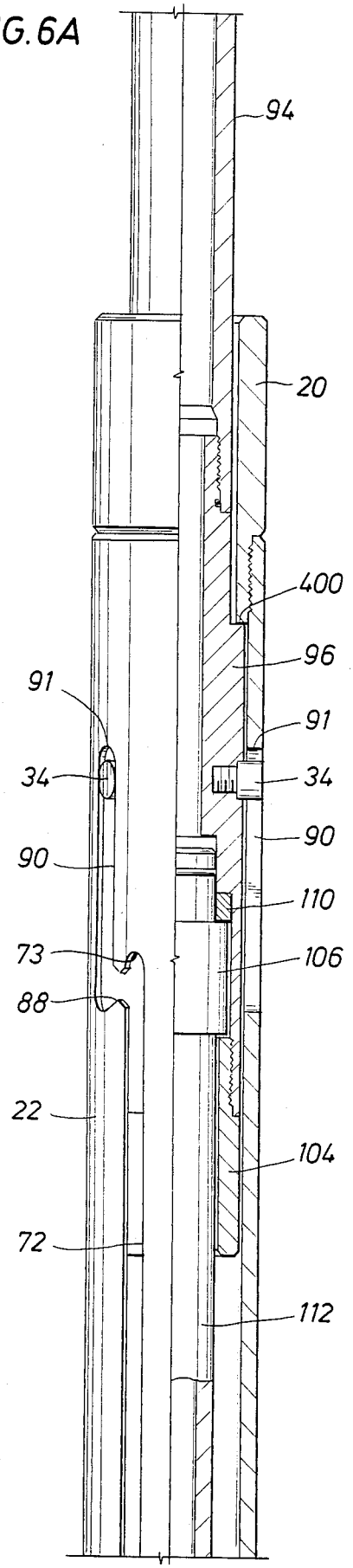
FIGS. 6A–6F are quarter-sectional views of selected, progressively lower portions of the apparatus in the pull out position.

Referring now to FIGS. 6A–6F, the pull out position is shown in detail. To assume the pull out position, the apparatus, if not already in its inflation position, is moved to the inflation position, with lugs 34 in engagement with shoulders 73. Pressure is held on the interior of the inner assembly to temporarily maintain the packers in their inflated condition and thereby permit relative movement between the inner and outer assemblies. The inner assembly is lowered slightly and then rotated clockwise to move lugs 34 through sections 88 of slots 36 and into respective runs 90. The inner assembly is then moved upwardly raising lugs 34 in run 90. Positioning of lugs 34 at or near shoulders 91 determines the pull out position. Preferably, in order to prevent the full weight of the outer assembly from being borne by lugs 34, the tool is designed so that shoulder 400 on sub 96 of the inner assembly will come into abutment with the lower end of sub 20 of the outer assembly prior to engagement of lugs 34 with shoulders 91 as shown in FIG. 6A.

Figure 6B:
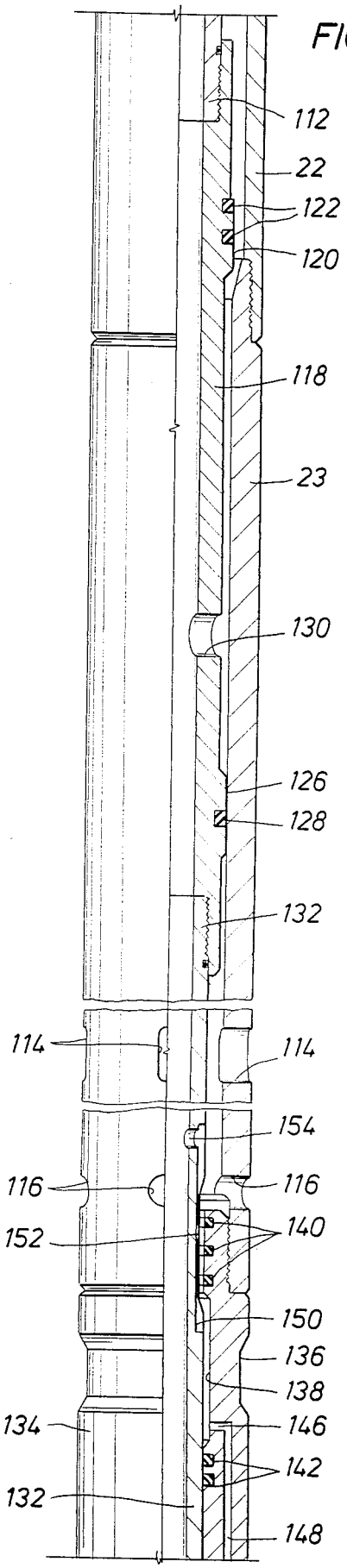
Figure 6C:
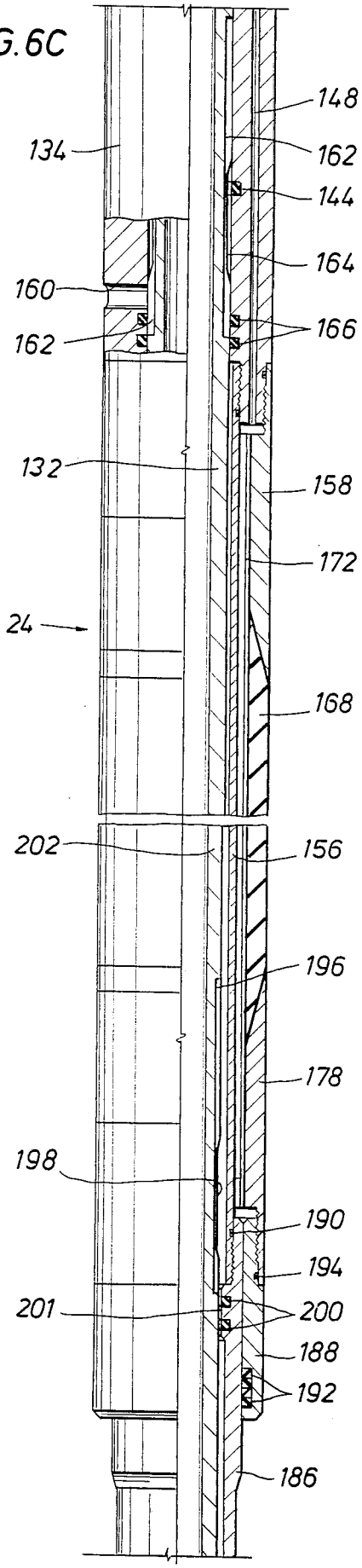

Referring to FIG. 6B, it can be seen that the lower ends of slots 150 in member 132 of the inner assembly have been brough into alignment with recess 138 in packer extension 134 of the outer assembly. Thus, the inlet 146 of the packer set chamber of upper packer 24 may communicate via recess 138 with slots 150. Fluid from the packer set chamber may bypass seals 140 through slots 150 and their interconnecting undercut 152. From the upper ends of slots 150, fluid may pass into a clearance between the inner and outer assemblies and into the well annulus through upper ports 116 of the outer assembly. Thus, the packer set chamber of upper packer 24 is vented into the annulus and deflated.

Figure 6D:
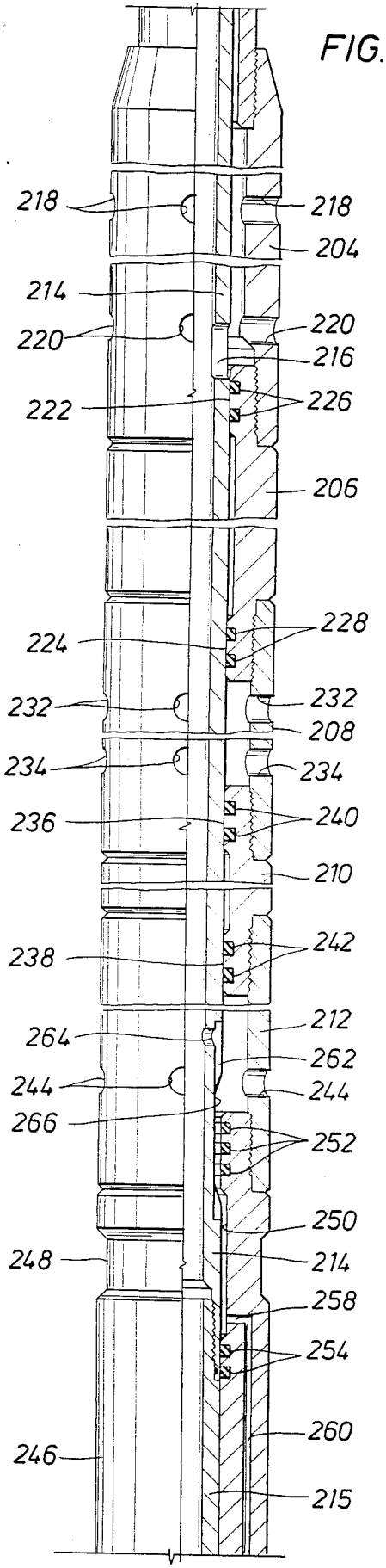
Figure 6E:
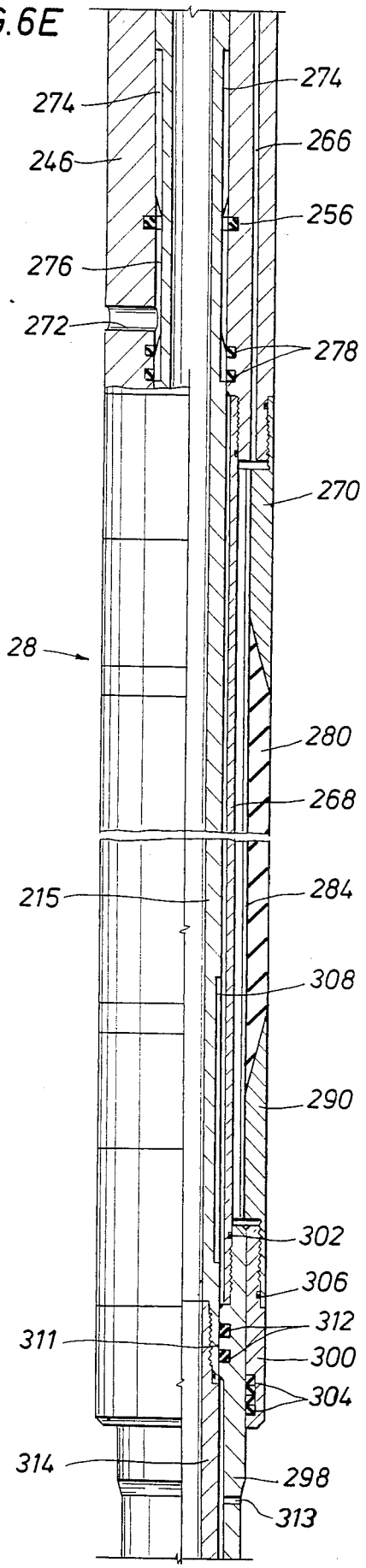
Figure 6F:
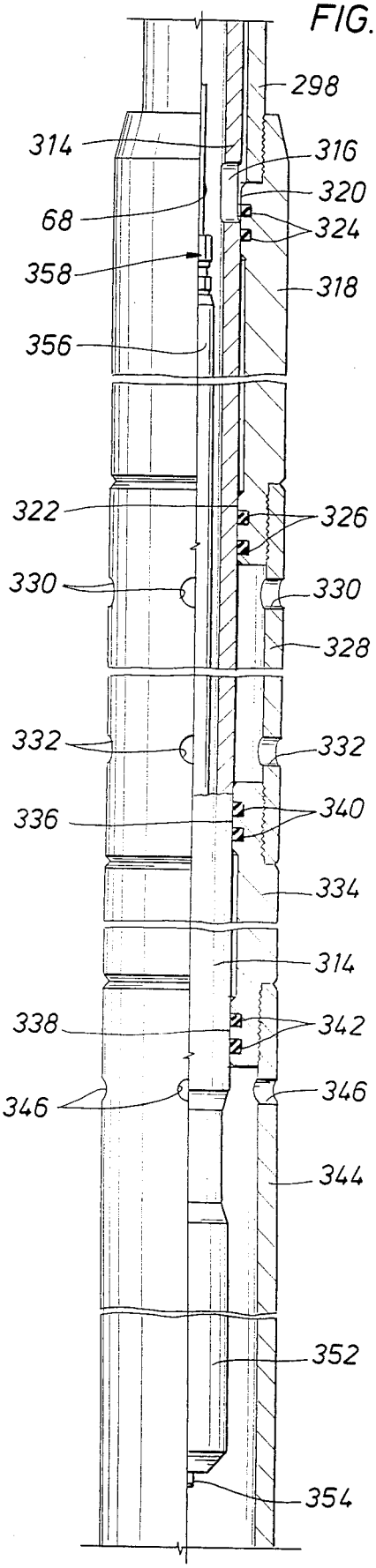

Referring to FIGS. 6D and 6E, it can be seen that the lower packer 28 and related parts have been moved into a similar configuration whereby the packer set chamber of lower packer 28 may be vented into the annulus between packers 24 and 28 and thereby deflated. Specifically, fluid may pass from the packer set chamber through inlet 258 into recess 250 and thence into slots 262 and their interconnecting undercut 266, bypassing seals 252. Above seals 252, the fluid may pass through the clearance between the inner and outer assemblies and out through mid ports 244.

The pull out position also permits the interior of the inner assembly to empty into the well bore by placing the fluid passage means of the inner assembly into communication with the upper port means of the outer assembly. Referring to FIGS. 6A and 6B, ports 130 of the inner assembly communicate through a clearance between the inner and outer assemblies with slots 36 and, thus, with the well bore. If desired, additional upper ports may be provided in the outer assembly for this purpose, e.g. near the upper end of sub 23.

Referring once again to FIGS. 2A–2J, illustrating the inflation position of the apparatus, and as previously mentioned, the inner assembly can be separately assembled and-as assembled-inserted into the outer assembly which is already made up. Theoretically, the inner assembly could be completely inserted into the outer assembly in fully assembled condition. To make such insertion possible, the outer assembly, at each point along its length, has an inner diameter greater than the outer diameter of the inner assembly at an adjacent point along its length and all points therebelow. This relationship between the diameters of the two assemblies prevails throughout all of the various operating positions of the tool, thereby permitting not only one step installation of the inner assembly into the outer assembly, but also permitting the aforementioned movements of the inner assembly with respect to the outer assembly to different operating positions.

In order to minimize wear of the various elastomeric seal rings of the tool, particularly during installation of the inner assembly into the outer assembly, each of the two tool assemblies, and indeed the tool in general, is divided into a plurality of lengthwise zones of successively decreasing sealing diameters. Referring to FIG. 2C, the first of these is defined by the outer diameters of seals 122 and 128 on the inner assembly and the matching inner diameter of section 23 of the outer assembly. The next successively smaller diameter is defined by the inner diameters of the various seals carried by the upper packer, specifically seals 140, 142, 144, 166 and 200, and the matching outer diameter of the major portion of section 132 of the inner assembly. The third and smallest set of sealing diameters is defined by seals 226 and all other seals therebelow on the outer assembly, and by the corresponding outer diameters of the major portions of sections 202, 214, 215 and 314 of the inner assembly. Thus, the seals carried by the outer assembly in the second or intermediate diameter zone will not be in rubbing contact with those (lowermost) portions of the inner assembly designed to seal against the seal rings in the lowermost or third zone as the inner assembly is lowered through the outer assembly during installation. As mentioned, this minimizes wear of the seal rings.

Numerous modifications may be made in the exemplary embodiment disclosed above without departing from the spirit of the invention. Accordingly, it is intended that the scope of the invention be limited only by the claims which follow.

What is claimed is:

1. Dual packer apparatus comprising:

a tubular outer assembly having an inner diameter which varies along its length and comprising an upper packer, a lower packer, and tubular spacer means interconnecting said upper and lower packers and longitudinally spacing said packers from each other;

said outer assembly further defining a respective packer set chamber associated with each of said packers for receipt of fluid whereby said packers may be set;

and a tubular inner assembly having an interior throughbore and an exterior periphery, said inner assembly having an outer diameter which varies along its length, said inner assembly being disposed generally coaxially within said outer assembly and interconnected with said outer assembly for relative telescopic movement of said assemblies between a plurality of relative positions, said inner assembly being adapted for coaxial connection to a well conduit whereby fluid may be directed through such well conduit into said interior throughbore, and said inner assembly defining fluid passage means communicating the interior throughbore with the exterior periphery of said inner assembly, and said fluid passage means further being selectively communicatable with said packer set chambers;

and wherein for each of said relative positions, the inner diameter of said outer assembly, at each point along its length, is greater than the outer diameter of said inner assembly at an adjacent point along its length and all points therebelow.

2. The apparatus of claim 1 further comprising a sensor means insertable, as a unit, into said inner assembly so as to extend along substantially the entire length of said inner assembly.

3. The apparatus of claim 2 wherein said sensor means comprises a monolithic tubular transmission body comprising a major portion of the length of said sensor means.

4. The apparatus of claim 2 wherein:

said sensor means comprises a lowermost probe member;

weight means secured to said probe member therebove;

and a tubular transmission body secured to and extending upwardly from said weight means;

and said inner assembly carries seat means adjacent its lower end for receipt of said probe member and positioning said probe member in communication with the exterior of said apparatus.

5. The apparatus of claim 4 wherein said transmission body comprises a length of coilable tubing.

6. The apparatus of claim 5 further comprising operator means associated with said apparatus adjacent the upper end thereof and connected to said transmission body of said sensor means for receiving and processing a signal from said probe member transmitted along said transmission body.

7. The apparatus of claim 1 further comprising a plurality of elastomeric seal rings each respectively carried by one or the other of said assemblies and having a sealing diameter for sealing against the opposite assembly, said assemblies having a plurality of lengthwise zones, the sealing diameters of the seal rings decreasing between successively lower zones.

8. Packer apparatus comprising:

a tubular outer assembly comprising an upper packer, a lower packer, and tubular spacer means interconnecting said upper and lower packers and longitudinally spacing said packers from each other, said outer assembly further defining a pair of packer set chambers each associated with a respective one of said packers for receipt of fluid whereby the packers may be set, and said outer assembly further having port means including upper port means communicating the interior with the exterior of said outer assembly above said upper packer, mid port means communicating the interior with the exterior of said outer assembly between said packers, and lower port means communicating the interior with the exterior of said outer assembly below said lower packer;

a tubular inner assembly disposed generally coaxially within said outer assembly and defining fluid passage means communicating the interior with the exterior of said inner assembly;

and a plurality of longitudinally spaced annular seal means carried by at least one of said assemblies for sealing between said assemblies;

said inner and outer assemblies being connected for telescopic relative movement between a plurality of positions varying the interrelation of said assemblies, said positions including an inflation position wherein said fluid passage means of said inner assembly communicates with said packer set chambers; and wherein said assemblies, in said inflation position, define a first annular pressure relief bypass therebetween communicating said mid port means with said upper port means, and a second annular relief bypass therebetween communicating said lower port means with said mid port means.

9. The apparatus of claim 8 wherein said positions further include a lower flow position wherein said fluid passage means of said inner assembly communicates with said lower port means of said outer assembly and said packer set chambers are sealed with respect to said inner assembly and blocked from said fluid passage means, and a mid flow position wherein said fluid passage means of said inner assembly communicate with said mid port means of said outer assembly and said packer set chambers are sealed with respect to said inner assembly and blocked from said fluid passage means.

10. The apparatus of claim 9 wherein, in said flow positions, at least one respective seal means is sealingly engaged between said assemblies within each of said bypasses to close said bypasses.

11. The apparatus of claim 10 wherein said seal means and said assemblies are arranged to maintain said packer set chambers sealed with respect to said inner assembly and blocked from said fluid passage means as said assemblies are moved between said lower flow and mid flow positions.

12. The apparatus of claim 11 wherein:

in said inflation position, said fluid passage means of said inner assembly are blocked from said mid and lower port means of said outer assembly;

in said lower flow position, said fluid passage means are blocked from said mid port means;

and in said mid flow position, said fluid passage means are blocked from said lower port means.

13. The apparatus of claim 9 wherein said positions further include an equalizing position wherein said upper, mid and lower port means of said outer assembly all communicate with said fluid passage means, and said packer set chambers are sealed with respect to said inner assembly and blocked from said fluid passage means.

14. The apparatus of claim 13 wherein said apparatus is adapted to automatically assume said equalizing position as it is moved from said inflation position to either of said flow positions.

15. The apparatus of either claims 9 or 13 wherein said positions further include a pull out position wherein each of said packer set chambers communicates with at least one of said port means of said outer assembly.

16. The apparatus of claim 15 wherein, in said pull out position, said fluid passage means of said inner assembly communicates with said port means of said outer assembly.

17. Dual packer apparatus comprising:

a tubular outer assembly comprising
an upper packer,
a lower packer,
and tubular spacer means interconnecting said upper and lower packers and longitudinally spacing said packers from each other, a tubular inner assembly disposed generally coaxially within said outer assembly;

annular seal means carried by at least one of said assemblies for sealing between said assemblies; and means interconnecting said inner and outer assemblies for telescopic relative movement between a plurality of operational positions, said interconnecting means comprising mating projecting and receiving formations relatively longitudinally and circumferentially movable and defining indexing means for determining at least some of said relative positions of said two assemblies;

wherein said inner assembly comprise swivel means permitting relative rotation between portions of said inner assembly respectively adjacent and below said interconnecting means whereby relative circumferential movements of said mating projecting and receiving formations may be affected without rotation of said portion of said inner assembly below said interconnecting means.

18. The apparatus of claim 17 wherein:

said outer assembly defines a pair of packer set chambers each associated with a respective one of said packers for receipt of fluid whereby the respective packer may be set, said outer assembly has mid port means communicating the interior with the exterior of said outer assembly between said packers, said outer assembly further has lower port means communicating the interior with the exterior of said outer assembly below said lower packer;

said inner assembly defines fluid passage means communicating the interior with the exterior of said inner assembly;

and said positions include
an inflation position wherein said fluid passage means of said inner assembly communicates with said packer set chambers,
a lower flow position wherein said fluid passage means of said inner assembly communicates with said lower port means of said outer assembly and said packer set chambers are sealed with respect to said inner assembly and blocked from said fluid passage means,
and a mid flow position wherein said fluid passage means of said inner assembly communicate with said mid port means of said outer assembly and said packer set chambers are sealed with respect to said inner assembly and blocked from said fluid passage means.

19. The apparatus of claim 18 wherein said projecting and receiving formations include a recess defined by one of said assemblies and a lug carried by the other of said assemblies and projecting into said recess, said lug being of substantially lesser longitudinal and circumferential extent than said recess, said recess having a first longitudinal run and a first shoulder at one end of said first run, positioning of said lug adjacent said first shoulder determining said inflation position of said assemblies.

20. The apparatus of claim 19 wherein said first shoulder is located at that end of said first run to which said lug will tend to move by virtue of gravity when said apparatus is supported by said inner assembly.

21. The apparatus of claim 19 wherein said recess further comprises a pair of pockets spaced longitudinally along said first run and extending therefrom in a common circumferential direction, positioning of said lug in one of said pockets determining said lower flow position, and positioning of said lug in the other of said pockets determining said mid flow position.

22. The apparatus of claim 21 further comprising valve means associated with inner assembly and operable by longitudinal movement of said inner assembly relative to said outer assembly to open and close the interior of said inner assembly, each of said pockets defining a pair of opposed longitudinally facing shoulders which, when positioned adjacent said lug, determine respective open and closed valve conditions for the respective position determined by said pocket.

23. The apparatus of claim 21 wherein:

said positions further include an equalizing position wherein each of said port means of said outer assembly communicates with said fluid passage means, and said packer set chambers are sealed with respect to said inner assembly and blocked from said fluid passage means;

said pockets are spaced from said first shoulder in the same longitudinal direction;

and said equalizing position is determined by positioning of said lug in a portion of said first run intermediate said first shoulder and said pockets.

24. The apparatus of claim 21 wherein:

said positions further include a pull out position wherein each of said packer set chambers communicates with at least one of said port means of said outer assembly;

and said recess further comprises a second run communicating with said first run and spaced circumferentially from said first run in the opposite direction from said pockets, positioning of said lug in at least a portion of said second run determining said pull out position of said assemblies.

25. The apparatus of claim 24 wherein said assemblies comprise interengagable stop means for preventing relative movement, in one direction, from said pull out position independently of said lug and recess.

26. The apparatus of claim 19 wherein said lug and recess are disposed above said upper packer.

27. The apparatus of claim 17 wherein, for each of said relative positions, said outer assembly, at each point along its length, has an inner diameter no less than the outer diameter of said inner assembly at an adjacent point along its length and all points therebelow.

28. The apparatus of either of claims 17 or 27 wherein said seal means comprises a plurality of elastomeric seal rings each respectively carried by one or the other of said assemblies and having a sealing diameter for sealing against the opposite assembly, said assemblies having a plurality of lengthwise zones, the sealing diameters of the seal rings decreasing between successively lower zones.

29. The apparatus of claim 17 wherein said swivel means permits 360° rotation between said portions of said inner assembly adjacent and below said interconnecting means.

30. Packer apparatus comprising:

a tubular outer assembly including at least one packer and defining a packer set chamber associated with said packer for receipt of fluid whereby said packer may be set, said packer set chamber having an inlet opening to the interior of said outer assembly;

a tubular inner assembly disposed generally coaxially within said outer assembly and interconnected with said outer assembly for relative telescopic movement of said assemblies between a plurality of relative positions including a first position in which said packer may be inflated or deflated and a second position in which said packer may be maintained in an inflated condition, said inner assembly having a packer set port extending therethrough from the interior to the exterior thereof, and said packer set port, in said first position, being disposed for communication with said chamber inlet;

a set of annular packer seals disposed coaxially between said inner and outer assemblies and including a first packer seal disposed longitudinally to one side of said packer set port and chamber inlet in said first position, a second packer seal disposed longitudinally to the opposite side of said packer set port and said chamber inlet in said first position, and an auxiliary packer seal disposed longitudinally across said second packer seal from said packer set port and said chamber inlet in said first position;

wherein movement of said assemblies from said first position to said second position causes movement of one of said packer set port or said chamber inlet toward said auxiliary packer seal;

and wherein said assemblies are dimensioned to provide, in said first position sealing engagement of said first packer seal between said assemblies, sealing engagement of said auxiliary packer seal between said assemblies, and clearance preventing sealing engagement of said second packer seal between said assemblies.

31. The apparatus of claim 30 wherein:

said packer seals are carried by said outer assembly;

said inner assembly comprises a pair of cylindrical seal surfaces above and below said packer set port and a relief section between said seal surfaces and adjacent said packer set port;

in said first position, one of said seal surfaces engages said first packer seal and the other of said seal surfaces engages said auxiliary packer seal;

and in said second position said one seal surface engages said first and second packer seals.

32. The apparatus of claim 31 wherein:

said outer assembly comprises two such packers, longitudinally spaced apart;

said inner assembly includes two such packer set ports, each associated with a respective one of said packers and having a respective pair of such seal surfaces and a respective such relief section disposed adjacent each of said packer set ports;

and there are two such sets of packer seals, each associated with a respective one of said packers.

33. A method of assembling a dual packer apparatus comprising the steps of:

assembling a tubular outer assembly comprising upper and lower packers interconnected and longitudinally spaced apart by tubular spacer means;

supporting said outer assembly on first support means;

assembling a tubular inner assembly, through which said packers may be inflated, separately from said outer assembly;

supporting said inner assembly on second support means as assembled;

lowering said inner assembly generally coaxially into said outer assembly as assembled;

interconnecting said inner and outer assemblies after the entirety of said inner assembly has been so lowered;

and releasing said first support means and supporting said interconnected inner and outer assemblies on said second support means.

34. The method of claim 33 wherein:

said outer assembly has slot means opening laterally therethrough;

and said assemblies are interconnected by securing lug means to said inner assembly and so as to extend into said slot means.

35. The method of claim 33 comprising the further steps of lowering a probe member through said inner assembly on a tubular transmission body and seating said probe member in a seat carried adjacent the lower end of said inner assembly.

36. The method of claim 35 wherein said probe member is lowered by the use of weight means secured thereto.

* * * * *